US005783352A

United States Patent [19]

Okae et al.

[11] Patent Number: 5,783,352

[45] Date of Patent: Jul. 21, 1998

[54] METHOD OF PRODUCING ELECTROPHOTOGRAPHIC TONER

[75] Inventors: Toshiro Okae; Masami Tsujihiro, both of Osaka, Japan

[73] Assignee: Mita Industrial Co., Ltd., Osaka, Japan

[21] Appl. No.: 734,843

[22] Filed: Oct. 23, 1996

Related U.S. Application Data

[62] Division of Ser. No. 325,929, Oct. 18, 1994, abandoned.

[30] Foreign Application Priority Data

Oct. 20, 1993 [JP] Japan ..... 5-262594
Oct. 29, 1993 [JP] Japan ..... 5-272597

[51] Int. Cl.[6] ..... G03G 9/08

[52] U.S. Cl. ..... 430/137; 430/110; 430/111

[58] Field of Search ..... 430/137, 111, 430/110

[56] References Cited

U.S. PATENT DOCUMENTS

| | | | |
|---|---|---|---|
| 4,777,104 | 10/1988 | Matsumoto et al. | 430/111 |
| 4,816,366 | 3/1989 | Hyosu et al. | 430/137 |
| 4,950,573 | 8/1990 | Yamaguchi et al. | 430/111 |
| 5,080,992 | 1/1992 | Mori et al. | 430/109 |
| 5,089,295 | 2/1992 | McNeil | 430/137 |
| 5,185,228 | 2/1993 | Maeda et al. . | |
| 5,213,926 | 5/1993 | Hanatani et al. . | |
| 5,246,808 | 9/1993 | Hanatani et al. . | |
| 5,258,251 | 11/1993 | Hanatani et al. . | |
| 5,272,031 | 12/1993 | Hanatani et al. . | |
| 5,275,901 | 1/1994 | Anno et al. | 430/111 |
| 5,300,386 | 4/1994 | Kabayashi et al. | 430/137 |
| 5,494,765 | 2/1996 | Fukami et al. | 430/59 |

*Primary Examiner*—Christopher D. RoDee
*Attorney, Agent, or Firm*—Beveridge, DeGrandi, Weilacher & Young, LLP

[57] ABSTRACT

Numerous projections are formed on the surface of toner particles by fine particles which are added to a monomer when preparing spherical toner particles by a suspension polymerization. Alternatively, spherical toner particles may be deformed when they are aggregated together with inorganic matter, and then the inorganic matter is chemically removed. The electrophotographic toner produced by deforming spherical toner particles has a narrow particle size distribution, reduced particle size, and excellent flowability. This improves the cleaning properties of the resultant toner, which can be scraped off the photoconductive drum using a cleaning blade.

14 Claims, 18 Drawing Sheets

METHOD OF PRODUCING ELECTROPHOTOGRAPHIC TONER

This is a divisional of application Ser. No. 08/325,929, filed on Oct. 18, 1994, entitled ELECTROPHOTOGRAPHIC TONER AND METHOD OF PRODUCING SAME, abandoned.

BACKGROUND OF THE INVENTION

The present invention relates to an electrophotographic toner used for an image forming apparatus using a so-called electrophotography, such as an electrostatic copying apparatus, a laser beam printer or the like, and also to a method of producing such a toner.

A normal electrophotographic toner is made by melting and kneading a fixing resin, such as a styrene acryl copolymer or the like, and additives including carbon black and the like serving as a coloring agent, then grinding the kneaded body, followed by a classification of the ground particles.

This grinding type toner, however, has a wide range of particle size distribution even after the classification. It is therefore difficult to uniformly charge the toner. Additionally, following problems arise.

Large values of particle diameter cause difficulty in obtaining images having a high resolution.

An irregularity in shape of particles obtained causes a problem that toner flowability is generally low, so that it is liable to cause toner blocking or the like.

There occurs some toner particles which are removed out by classification. This lowers the yield, thus being poor in productivity.

Recently, as a method of producing an electrophotographic toner in place of the aforesaid grinding method, there have been proposed a toner producing method using resin particles produced by suspension polymerization, dispersion polymerization or spray drying.

In a toner producing method using suspension polymerization, there is prepared a liquid monomer-phase mixture containing (i) a water-insoluble polymerizable monomer which is a raw material of a fixing resin, (ii) a polymerization initiator soluble in the monomer, and (iii) additives including a coloring agent and the like. While the mixture is suspended, in the form of drops, in an aqueous dispersion medium such as water or the like, the monomer-phase mixture is heated such that the monomer in the drops is polymerized. In this method, each drop which has been suspended in the aqueous dispersion medium, is turned into one toner particle.

In a toner producing method using dispersion polymerization, a monomer which is a raw material of a fixing resin, and additives including a coloring agent and the like are dissolved, together with a dispersion stabilizer, in a medium in which the monomer is soluble but a polymer thereof is insoluble. Then, the monomer is polymerized under stirring to deposit spherical toner particles in the medium.

In a toner producing method using spray drying, there is prepared a solution for spray-drying obtained by dissolving or dispersing, in a suitable medium, the fixing resin above-mentioned and additives including a coloring agent and the like. While the solution is sprayed in the form of mist with a spraying device, the solvent is dried and removed. In this method, each sprayed mist is turned into one toner particle.

The electrophotographic toner produced by each of the methods above-mentioned, presents a narrow particle size distribution. A further reduction in particle size is accomplished by adjusting the production conditions. This toner is excellent in charging properties, and can produce a high-quality image. Since the toner does not need classification, no toner particles are removed, thus resulting in excellent productivity.

The electrophotographic toner particles produced by the above methods are spherical in most cases. Accordingly, they are excellent in flowability but poor in cleaning properties. Specifically, when the spherical toner particles remain on the surface of the photoreceptor after an image formation, it is difficult to remove such toner particles from the photoreceptor surface with the use of a cleaning blade that contacts the photoreceptor by pressure.

To improve the cleaning properties with the use of a cleaning blade, there are proposed a variety of techniques for deforming spherical toner particles at the time of or after the production thereof.

Examples include a method wherein to a monomer-phase mixture used in suspension polymerization, there is added fine particles of crosslinking resin presenting a relatively low degree of crosslinking, which has been synthesized by emulsion polymerization, with one to five times of the monomer, thereby remarkably increasing the viscosity of the monomer-phase mixture, whose drops are allowed to deform in an aqueous dispersion medium at the time of suspension dispersion, thus obtaining toner particles presenting irregular shapes (See Japanese Patent Unexamined Publication 4-100058).

That is, this method is based on the effect that due to the low degree of crosslinking, the fine particles of crosslinking resin are swollen by the monomer or partially dissolved therein to form a uniform phase with the monomer. As a result, an addition of the fine particles in quantity causes a remarkable increase in the viscosity of the monomer-phase, thus failing to become perfectly spherical.

The toner thus obtained, however, contains a great amount of crosslinking resin, thus being poor in fixing properties with respect to paper or the like, which is one performance essential to a toner. Further, this toner deforms just as a toner produced by a grinding, so that it loses superior flowability owing to its spherical shape, which is one feature of a toner prepared by suspension polymerization. Accordingly, this toner is poor in flowability like the toner produced by the grinding.

As a second method, there is proposed to physically or mechanically attach, to the surface of toner particles produced by suspension polymerization or the like water-insoluble inorganic fine particles of a particle size which is smaller than that of the toner, or to shoot the inorganic fine particles over the surfaces of the toner particles (see Japanese Patent Unexamined Publication 2-162362).

In the second method, a large number of projections are formed on the surface of the spherical toner particles by the inorganic fine particles, thus obtaining cleaning properties superior to that of the spherical toner. The toner produced by the second method basically comprises spherical toner particles. This toner has the advantages that it presents a narrower particle size distribution; the particle can be reduced in size; and that it is excellent in flowability, thus preserving the advantages inherent in spherical toner particles.

This toner, however, has the disadvantage that the inorganic fine particles come off relatively easily due to the failure in integrating with the toner particles. Since the toner particles are basically spherical as previously described, inorganic fine particles coming-off will result in a lowering of toner cleaning properties. Further, inorganic fine particles which come off may adversely affect an image formation.

As a third method, there is proposed to aggregate spherical toner particles by heating or an application of pressure, and to forcibly disintegrate the resulting aggregate using a jet mill or the like, thus deforming the toner particles (See Japanese Patent Unexamined Publications 2-167564, 3-126956 and 3-248163 for example).

In production of an electrophotographic toner by the third method, if the temperature applied or the pressure applied is excessively high, the toner particles are strongly welded to one another, and are substantially integrated with one another. Accordingly, when disintegrating the aggregate, not only the aggregate is decomposed at the interfaces of the toner particles but also toner particles themselves are crushed. As a result, there occurs particles of a size which is smaller than that of the original toner particles. There also occurs particles comprising a plurality of toner particles in the welded state, of which the particle size is greater than that of the original toner particles.

Therefore, the electrophotographic toner produced by the third method cannot retain the initial particle size and the initial particle size distribution. Its particle size distribution expands like in the toner prepared by the grinding. This causes the problems that it is difficult to uniformly charge the toner and that productivity will be lowered due to the necessity of classification.

By lowering the temperature or the pressure to be exerted at the time of aggregation, the above problems can be solved. However, the resulting toner particles keep an almost spherical shape, and are hardly deformed, so that the cleaning properties did not improve so much.

As a fourth method, there is proposed an improved manner wherein when aggregating toner particles, inorganic fine particles having an average particle size smaller than that of the toner particles are blended with the toner particles to prevent them from being welded with each other, thereby facilitating the disintegration of the aggregate (See Japanese Patent Unexamined Publications 2-273757 and 2275470).

In the fourth method, even though the toner particles are aggregated firmly to some extent, the inorganic fine particles intervening among the toner particles prevent the welding between the toner particles. Therefore, the disintegrated toner particles do not include such particles in which a plurality of toner particles remain being welded with one another and whose size is greater than the particle size of the original toner particles.

Further, since there is no fear of welding, it is possible to sufficiently increase the temperature or pressure exerted at the time of aggregation, so that the toner particles can be sufficiently deformed. Thus, the resulting toner particles are also excellent in cleaning properties.

The fourth method, however, still employs a jet mill or the like for a disintegration of aggregates. It is therefore impossible to avoid an occurrence of particles in which toner particles themselves have been collapsed whose particle size is smaller than the particle size of the original toner particles.

Thus, the initial particle size and the initial particle size distribution cannot be retained. As a result, its particle size distribution expands likewise the toner produced by grinding. It is therefore impossible to perfectly solve the problems that it is difficult to uniformly charge the toner and that productivity will be lowered due to the necessity of classification.

Further, a great amount of inorganic fine particles remain on the surface of the resulting toner particles. When using the toner, such inorganic fine particles may come off to adversely affect the toner characteristics.

In particular, untreated inorganic matter generally has a hydrophilic character. This remarkably lowers humidity resistance and environmental stability of the toner particles.

On the other hand, inorganic matter given a hydrophobic treatment does not cause the aforesaid problems. In any case, inorganic matter remains in great quantities on the surfaces of the toner particles and is not perfectly integrated therewith. Thus, when using the toner, such inorganic matter may come off to exert an effect on toner charging properties.

SUMMARY OF THE INVENTION

It is a main object of the present invention to provide an electrophotographic toner excellent in cleaning properties with the use of a cleaning blade, yet assuring the advantages inherent in spherical toner particles of narrower distribution of particle size, of being capable of reducing the particle size, and of being excellent in flowability.

It is another object of the present invention to provide a method of producing the above electrophotographic toner.

To achieve the objects above-mentioned, the inventors have first studied a method wherein fine particles insoluble in a monomer are added to a monomer-phase mixture and then subjected to suspension polymerization such that numerous projections are formed on the surface of spherical toner particles by the fine particles.

The toner produced by this method is expected to be excellent in flowability because it is basically spherical, and in cleaning properties because numerous projections are formed on the toner surfaces. Further, it is expected that the projections do not readily come off because they are being integrated with the toner particles by a polymeride of a monomer.

However, no detailed study has been reported on formation of projections on the surface of the toner particles using the technique above-mentioned. Therefore, it can be said that little study has been made on fine particles suitable for forming such projections.

In a case where the above water insoluble inorganic fine particles are used as fine particles for forming projections, the inorganic fine particles exhibit a lower affinity for a monomer and a higher hydrophilic character than the monomer. Even though such inorganic fine particles are thoroughly dispersed in a monomer-phase mixture, if the monomer-phase mixture is suspended, in the form of drops, in an aqueous dispersion medium, the inorganic fine particles do not remain on the drop surfaces but readily move in the aqueous dispersion medium. As a result, the inorganic fine particles do not exist at all, or exist in extremely small quantity on the surfaces of toner particles after polymerization, thus failing to securely form the projections on the toner particle surfaces.

Upon this, the inventors have examined the optimum type, mixing ratio, particle size and the like for fine particles in order to form projections on the surfaces of toner particles, resulting in the completion of the present invention.

In the present invention, fine particles of crosslinking resin having a primary particle size of 1 to 30% of the toner particle size, or water-insoluble inorganic fine particles having the above primary particle size, to which a treatment to increase affinity for a polymerizable monomer serving as a raw material of a toner fixing resin has been carried out, is admixed in an amount in a range of 0.1 to 100% by weight to the monomer, thereby obtaining a monomer-phase mixture. The monomer-phase mixture is polymerized while suspending in the form of drops in a dispersion medium that does not solve the monomer, thus obtaining an electrophotosensitive toner. This toner is provided on the surface thereof with numerous projections made of either of the aforesaid fine particles.

This electrophotographic toner has a narrower particle size distribution, being capable of reducing in a particle size and being excellent in flowability. Further, there are provided, on the surface of a spherical toner particle, numerous projections made of the specific fine particles. Therefore, while retaining the aforesaid advantages, it is possible to improve cleaning properties with the use of a cleaning blade, which have been the disadvantages of spherical toner particles.

A method of producing an electrophotographic toner in the present invention comprises the steps of:

blending (i) fine particles of crosslinking resin having a primary particle size of 1 to 30% of the toner particle size, or (ii) water-insoluble inorganic fine particles having the above primary particle size, to which a treatment to increase affinity for a polymerizable monomer serving as a raw material of a toner fixing resin has been carried out, in an amount in a range of 0.1 to 100% by weight to the monomer to obtain a monomer-phase mixture.

polymerizing the monomer-phase mixture while suspended, in the form of drops, in a dispersion medium in which the monomer is insoluble; and providing the toner, on the surface thereof, with numerous projections made of either of the aforesaid fine particles.

This method enables the production of an electrophotographic toner having superior properties as mentioned earlier. Further, the electrophotographic toner produced by this method does not call for classification. Therefore, the toner can be produced in higher yield and productivity.

The inventors have also examined the method wherein toner particles are aggregated and deformed as previously described, and have studied a method of decomposing an aggregate of toner particles with no affect on the toner particles themselves, instead of a forcible disintegration of the aggregate.

Then, the inventors have had the following finding. Toner particles are aggregated with inorganic matter intervening thereamong, causing the toner particles to be deformed. Thereafter, the inorganic matter is chemically dissolved and removed. This allows the aggregate to be decomposed without causing such a problem that toner particles themselves are crushed as done by a disintegration. It is therefore possible to obtain toner particles sufficiently deformed while retaining the initial particle size and the initial particle size distribution.

That is, another electrophotographic toner according to the present invention is produced by the steps of:

preparing almost spherical toner particles by a dispersion polymerization;

aggregating the toner particles with inorganic matter intervening thereamong, causing the toner particles to be deformed; and chemically dissolving and removing the inorganic matter to decompose the aggregate.

The electrophotographic toner thus obtained has a narrower particle size distribution, and is capable of reducing in particle size, and is excellent in flowability. Therefore, while retaining the aforesaid properties, it is possible to improve cleaning properties with the use of a cleaning blade, which is one of the disadvantages of conversional spherical toner particles.

A method of producing such an electrophotographic toner comprises the steps of:

preparing almost spherical toner particles by a suspension polymerization, a dispersion polymerization, a spray-drying or the like;

aggregating the toner particles thus produced with inorganic matter intervening thereamong, causing the toner particles to be deformed; and chemically dissolving and removing the inorganic matter to decompose the aggregate of the toner particles and the inorganic matter.

This method can produce an electrophotographic toner having excellent characteristics as mentioned earlier. Further, the electrophotographic toner thus produced does not call for classification. Advantages of this method are higher yield and greater production.

Further, in this method, the degree of deformation can be adjusted by controlling the degree of aggregation. Also, the energy cost can be reduced because no mechanical disintegrating means, such as a jet mill, is required.

DETAILED DESCRIPTION OF THE INVENTION

Figure 1:
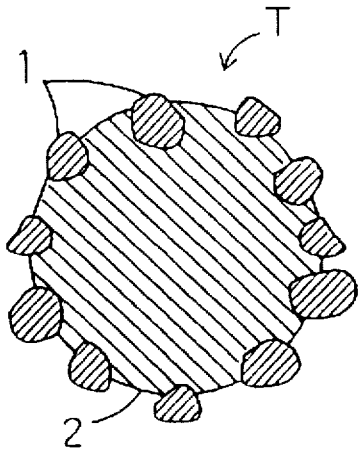
FIG. 1 is a section view of a particle of an electrophotographic toner in the present invention.

The following description will discuss the present invention.

A detailed description will be made of an electrophotographic toner in which numerous projections are formed over the surface of spherical toner particles by specific fine particles added to a monomer-phase mixture to be used in a suspension polymerization. A description will also be made of a method of producing such a toner.

The present invention employs fine particles of crosslinking resin or water-insolvable inorganic fine particles as fine particles for forming projections on the surface of toner particles.

For the former fine particles of crosslinking resin, any of the conventional ones is applicable. Most preferred is fine particles having such a degree of crosslinking density wherein neither swelling nor dissolution in a monomer occurs under the temperature for a monomer polymerization.

Examples of the crosslinking resin include substances obtained by polymerizing bifunctional to multifunctional monomers. The aforesaid substances include divinyl compounds such as divinyl benzene; diallyl compounds such as diallyl phthalate, diallyl isophthalate, diallyl adipate, diallyl glycolate, diallyl maleate, diallyl sebacate; triallyl compounds such as triallyl phosphate, triallyl aconitate, triallyl cyanurate, trimelliticacid allyl ester, pyromelliticacid allyl ester; diacrylate compounds such as 1,6-hexane diol diacrylate, neopentyl glycol diacrylate, ethylene glycol diacrylate, diethylene glycol diacrylate, polyethylene glycol diacrylate, polypropylene glycol diacrylate, butylene glycol diacrylate, pentaerythritol diacrylate, 1,4-butane diol diacrylate; triacrylate compounds such as trimethylolpropane triacrylate, pentaerythritol triacrylate; dimethacrylate compounds such as 1,6-hexane diol dimethacrylate, neopentyl glycol dimethacrylate, ethylene glycol dimethacrylate, diethylene glycol dimethacrylate, polyethylene glycol dimethacrylate, polypropylene glycol dimethacrylate, butylene glycol dimethacrylate; trimethacrylate compounds such as trimethylolpropane trimethacrylate; poly(meth)acrylate compounds such as dipentaerythritol hexacrylate, tetramethylol methane tetraacrylate, acrylate of N,N,N',N'-tetraxis-(β-hydroxyethyl)ethylene diamine; allyl-acrylic compounds such as allyl acrylate, allyl methacrylate; acrylamide compounds such as N,N'-methylene bisacrylamide, N,N'-methylene-bismethacrylamide; prepolymers such as polyurethane acrylate, epoxy acrylate, polyether acrylate, polyester acrylate, among others.

The above mentioned bifunctional to multifunctional monomers may be used alone, or two or more types thereof may be copolymerized. A monomer serving as a raw material of toner particles, to be discussed later, may be used for a copolymerization if it does not cause a significant decrease in the crosslinking density of a polymer.

No particular restrictions are imposed on a method of producing the fine particles of crosslinking resin from any of the multifunctional monomers above-mentioned. As will be discussed later, the particle size of the fine particles is required to be as fine as 1 to 30% of toner particle size, and the fine particles are required to present a sharp particle size distribution in order to unify the magnitudes of the projections on the toner particle surfaces.

For producing such fine particles, the so-called dispersion polymerization is ideal. Specifically, this method comprises the steps of:

dissolving the aforesaid multifunctional monomers, together with a dispersion stabilizer and the like, in a medium in which the monomer is soluble but the polymer is insoluble; and polymerizing the resulting solution under stirring.

With a method using grinding and classification of a mass-like crosslinking resin, it is difficult to produce such fine particles which have a sharp particle size distribution.

On the other hand, fine particles produced by an emulsion polymerization tend to have a lower particle size than those produced by a dispersion polymerization. It is therefore a possibility that the particle size of the fine particles thus produced are below the range above-mentioned, thus becoming adequate for use. That depends on the particle size.

As discussed above, the fine particles of crosslinking resin have a certain degree of crosslinking density, and are neither swollen by nor dissolved in a monomer-phase mixture at the time of the suspension polymerization. Therefore, these fine particles of crosslinking resin are distinctly phase-separated from the monomer-phase mixture. For example, fine particles produced by a dispersion polymerization, contain a hydrophilic group resulting from a dispersion stabilizer. Therefore, every fine particle of crosslinking resin is hydrophilic to a certain extent.

When a monomer-phase mixture containing the aforesaid fine particles of crosslinking resin is suspended, in the form of drops, in an aqueous dispersion medium, a suitable balance between the hydrophilic nature and affinity for the monomer causes the fine particles to move to the surfaces of the drops. Such fine particles do not move further into the aqueous dispersion medium, thus remaining on the drop surfaces. This enables projections to be securely formed on the surfaces of toner particles when polymerized, so as to be integral with toner particles.

The primary particle size of the aforesaid fine particles is limited to a range of the 1 to 30% of toner particle size. If it is below the above range, projections formed on the surfaces of the toner particles are too small to improve the cleaning properties with the use of a cleaning blade. On the other hand, if it exceeds the range, projections formed on the surfaces of the toner particles are too big, resulting in irregular toner particles and a decrease in toner flowability.

The proportion of the fine particles of crosslinking resin, with respect to the monomer-phase mixture, is limited to a range of 0.1 to 100% by weight of the monomer. If it is below the above range, the number of projections formed on the surface of toner particles is too small to improve cleaning properties with the use of a cleaning blade. If it exceeds the range, the viscosity of the monomer-phase mixture is too high, resulting in irregular toner particles and a decrease in toner flowability.

Likewise the aforesaid fine particles of crosslinking resin in the present invention, water-insoluble inorganic fine particles used for forming the projections on the toner include a variety of conventional compounds such as tribasic calcium phosphate, calcium sulfate, magnesium carbonate, barium carbonate, calcium carbonate, aluminum hydroxide, silicon dioxide (silica), among others. These compounds may be used alone or in combination of plural types.

Various methods may be adopted for increasing affinity of the inorganic fine particles for a monomer. A simple and effective method is to treat the inorganic fine particles with a coupling agent, or to graft the inorganic fine particles with a polymerizable monomer identical with or different from the monomer above-mentioned.

For the coupling agent, any of the conventional coupling agents such as a titanate coupling agent, a silane coupling agent, an aluminum coupling agent can be used alone, or in combination thereof.

No particular restrictions are imposed on the amount of the coupling agent. It is desirable that the coupling agent is normally used in a range of about 0.1 to about 10 parts by weight to 100 parts by weight of the inorganic fine particles. If it is below the above range, the inorganic fine particles might fail in enhancing affinity for the monomer. If it exceeds the range, toner charging properties might be affected.

For the monomer, there can be used a monomer identical with or different from the monomer being used as a raw material for the toner particles. When using a monomer different from the monomer, it is desirable to use a monomer that can form a polymer excellent in compatibility both for the monomer serving as a raw material of the toner particles, and with a polymer thereof. For the aforesaid monomer, one that satisfies these conditions can be selected from the monomers serving as a raw material of the toner particles, to be discussed later.

In the present invention, the degree of the grafting treatment by a monomer is not limited. But it is preferable to carry it out such that the inorganic fine particles are coated at the surfaces thereof with a polymer in a range of about 0.1 to about 5 parts by weight to 100 parts by weight of the inorganic fine particles. If the proportion of polymer is below the above range, the inorganic fine particles might fail in enhancing affinity with the monomer of the inorganic fine particles. If it exceeds the above range, the affinity for the monomer becomes too high. As a result, the inorganic fine particles might be entrapped in the toner particles, thus failing in making the inorganic fine particles project from the surfaces of the toner particles.

The treatment of the inorganic fine particles for a coupling agent or a monomer may be conducted prior to a toner particle production using a suspension polymerization. It is preferable to conduct this treatment in the toner producing processes, particularly in preparing of a monomer-phase mixture, in view of working efficiency and the like.

In the treatment with a coupling agent for example, when preparing a monomer-phase mixture by blending a monomer with inorganic fine particles and additives such as carbon black and the like, a predetermined amount of the coupling agent is added so that the inorganic fine particles are treated simultaneously with the preparation of the monomer-phase mixture.

In the grafting treatment using a monomer, inorganic fine particles are dispersed in the monomer to conduct a grafting treatment. Thereafter, additives such as carbon black and the like are added, and when necessary, there may be added a monomer identical with or different from the above monomer, thereby to prepare a monomer-phase mixture.

Likewise the fine particles of crosslinking resin, the inorganic fine particles treated with a coupling agent or a monomer move to the surfaces of drops but do not move further into an aqueous dispersion medium, because of a suitable balance between the hydrophilic nature and affinity for the monomer. Thus, the inorganic fine particles remain on the drop surfaces, and securely form projections on the surfaces of the toner particles when polymerized, so as to be integral with the toner particles.

The primary particle size of these inorganic fine particles is limited to a range from 1 to 30% the of toner particle size, for the same reasons discussed in connection with the fine particles of crosslinking resin. Similarly, the proportion of the inorganic fine particles with respect to the monomer-phase mixture is limited to a range of 0.1 to 100% by weight of the monomer.

This electrophotographic toner of the present invention is produced by a process comprising the steps of:

suspending and dispersing, in an aqueous dispersion medium, a monomer-phase mixture containing a monomer and fine particles of crosslinking resin or inorganic matter in the specific particle size and in the specific proportion to prepare spherical drops;

polymerizing the spherical drops at a temperature from −30° to 90° C., particularly from 30° to 80° C., for about 0.1 to 50 hours. To restrain the termination reaction of polymerization due to oxygen, it is desirable to substitute the inside of the reaction system with inert gas.

FIG. 1 shows, in section, an electrophotographic toner T thus obtained in the present invention. As shown in FIG. 1, an almost spherical toner particle 2 comprising a polymeride of a monomer is provided on the surface thereof with a large number of projections made up of a number of fine particles 1 (i.e., fine particles of crosslinking resin or inorganic matter), the fine particles 1 being integral with the toner particle 2 by the polymeric product.

No particular restrictions are imposed on this particle size of this electrophotographic toner. To obtain an image of high resolution, however, it is desirable that the medium particle size is in a range from 4 to 20 μm, preferably about 10 μm, and the particle size dispersion is not greater than 1.50, preferably not greater than 1.40.

For the aqueous dispersion medium for producing this electrophotographic toner by a suspension polymerization, there may be used water or a mixed solvent mainly composed of water, which is incompatible with the monomer-phase mixture. Most preferred is water.

To stabilize the dispersibility of the drops of the monomer-phase mixture, it is desirable to add a dispersion stabilizer to an aqueous dispersion medium. Examples of the dispersion stabilizer include a water-soluble high polymer such as polyvinyl alcohol; and the water-insoluble inorganic fine particles as, previously mentioned. In view of the environmental stability, flowability, toner charging properties, the above inorganic fine particles are preferred to the water-soluble high polymer which might be entrapped by the surfaces of the toner particles to cause the same to be hydroscopic. It is essential that the inorganic fine particles serving as a dispersion stabilizer are, in nature, not entrapped by the monomer-phase mixture. Therefore, untreated inorganic fine particles are preferred.

The amount of the inorganic fine particles serving as a dispersion stabilizer may be similar to that of the conventional one.

To successfully disperse the monomer-phase mixture in an aqueous dispersion medium, it is desirable to use a surfactant. To prevent bubbles from being bitten, it is desirable to add the surfactant after the addition of the monomer-phase mixture.

For the surfactant, any of the conventional anionic, cationic and nonionic surfactants can be used. In consideration for a desired toner particle size of about 10 μm, the surfactant needs to be excellent in suspensibility. Further, in order that a surfactant does not affect the characteristics of the resulting toner, it is desired that the surfactant can readily be removed from the toner. The surfactant may be added in a suitable amount according to the proportions of a monomer-phase mixture and an aqueous dispersion medium.

The monomer-phase mixture may contain, at least, a monomer, the aforesaid fine particles of crosslinking resin or water-insoluble inorganic fine particles to which the treatment to increase affinity for a monomer has been carried out, a coloring agent, and a charge controlling agent. No particular restrictions are imposed on other ingredients to be added. There may be added a variety of additives (which are soluble in a monomer-phase mixture and insoluble in an aqueous dispersion medium).

For the monomer for forming a monomer-phase mixture, any radical polymerizable monomer may be used. Examples thereof include a variety of conventional compounds such as a monovinyl aromatic monomer, an acrylic monomer, a vinyl ester monomer, a vinyl ether monomer, a diolefin monomer, a monoolefin monomer, a halogenated olefin monomer, a polyvinyl monomer, among others.

For the monovinyl aromatic monomer, there may be used a monovinyl aromatic hydrocarbon represented by the following general formula:

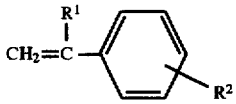

(1)

wherein $R^1$ is a group selected from the group consisting of: a hydrogen atom, a lower alkyl group and a halogen atom, and $R^2$ is a group selected from the group consisting of: a hydrogen atom, a lower alkyl group, a halogen atom, an alkoxy group, an amino group, a nitro group, a vinyl group, a sulfo group, a sodium sulfonate group, a potassium sulfonate group and a carboxyl group.

Examples of this monovinyl aromatic hydrocarbon include styrene, α-methylstyrene, vinyltoluene, α-chlorostyrene, o-chlorostyrene, m-chlorostyrene, p-chlorostyrene, p-ethylstyrene, styrene sodium sulfonate, divinylbenzene, among others.

For the acrylic monomer, there may be used an acrylic monomer represented by the following general formula:

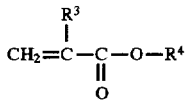

(2)

wherein $R^3$ is a hydrogen atom or a lower alkyl group and $R^4$ is a group selected from the group consisting of: a hydrogen atom, a hydrocarbon group having up to 12 carbon atoms, a hydroxyalkyl group, a vinyl ester group and a aminoalkyl group.

Examples of this acrylic monomer include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl-β-hydroxyacrylate, butyl-γ-hydroxyacrylate, butyl-δ-hydroxyacrylate, ethyl β-hydroxymethacrylate, propyl-γ-aminoacrylate, propyl-γ-N,N-diethylaminoacrylate, ethylene glycol dimethacrylate, tetraethylene glycol dimethacrylate, among others.

For the vinyl ester monomer, there may be used a vinyl ester monomer of the following general formula:

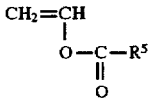

(3)

wherein $R^5$ is a hydrogen atom or a lower alkyl group.

Examples of this vinyl ester monomer include vinyl formate, vinyl acetate, vinyl propionate, among others.

For the vinyl ether monomer, there may be used a vinyl ether monomer of the following general formula:

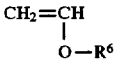

(4)

wherein $R^6$ is a monovalent hydrocarbon group having at most 12 carbon atoms.

Examples of this vinyl ether monomer include vinyl methyl ether, vinyl ethyl ether, vinyl-n-butyl ether, vinyl phenyl ether, vinyl cyclohexyl ether, among others.

For the diolefin monomer, there may be used a diolefin monomer of the following general formula:

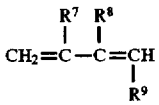

(5)

wherein $R^7$, $R^8$, $R^9$ are the same or different, and are selected form the group consisting of: hydrogen atoms, lower alkyl groups and halogen atoms.

Examples of this diolefin monomer include butadiene, isoprene, chloroprene, among others.

For the monoolefin monomer, there may be used a monoolefin monomer of the following general formula:

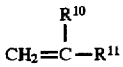

(6)

wherein $R^{10}$ and $R^{11}$ are the same or different, and are hydrogen atoms or lower alkyl groups.

Examples of this monoolefin monomer include ethylene, propylene, butene-1, pentene-1, 4-methylpentene-1, among others.

Examples of the halogenated olefin monomer include vinyl chloride, vinylidene chloride, among others.

Examples of the polyvinyl monomer include divinyl benzene, diallylphthalate, tricyanurate, among others.

The compounds above-mentioned may be used alone or in combination of plural types. For example, when producing a toner containing the most prevailing styreneacrylic fixing resin, styrene and an acrylic monomer may be used jointly, as a monomer.

A polymerization initiator for initiating the polymerization of the above monomer is added to a monomer-phase mixture.

It is desirable that the polymerization initiator is insoluble in an aqueous dispersion medium, and is compatible with a monomer.

Examples thereof include azo compounds such as azobisisobutyronitrile, 2,2'-azobis-(2,4-dimethyl valeronitrile), 2,2'-azobis-(4-methoxy-2,4-dimethyl valeronitrile), 2,2'-azobis-(2-cyclopropyl propionitrile), 2,2'-azobis-(2-methylpropionitrile), 2,2'-azobis-(2-methylbutyronitrile), 1,1'-azobis-(cyclohexane-1-carbonitrile), 2-phenylazo-4-meth-oxy-2,4-dimethyl valeronitrile, dimethyl-2,2'-azobis(2-methylpropionate); and peroxides such as cumene hydroperoxide, t-butylhydroperoxide, dicumyl peroxide, di-t-butylperoxide, benzoyl peroxide, lauroyl peroxide, among others.

In the case where polymerization is conducted using ultraviolet rays, visible light or the like, there may be used conventional photopolymerization initiators, which may be used alone or in combination of plural types.

The proportion of the polymerization initiator is in a range from 0.001 to 10 parts by weight, preferably from 0.01 to 0.5 parts by weight to 100 parts by weight of a monomer.

The polymerization can also be initiated using γ-rays, acceleration electron beams or the like. In such a case, no polymerization initiator is needed. Alternatively, it can be started by a combination of ultraviolet rays and any photosensitizers.

Examples of the coloring agent include the following compounds:

Black coloring agents: Carbon black, Nigrosine dye (C.I. No. 50415B), Lamp black (C.I. No. 77266), Oil black, Azo oil black;

Red coloring agents: Dupont oil red (C.I. No.26105), Rose Bengal (C.I. No. 45435), Orient oil red #330 (C.I. No. 6050);

Yellow coloring agents: Chrome yellow (C.I. No. 14090), Quinoline yellow (C.I. No. 47005);

Green coloring agents: Malachite green Oxalate (C.I. No.42000); and

Blue coloring agents: Chalco oil blue (C.I. No. azoec blue 3), Anilineblue (C.I. No. 50405), Methylene blue chloride (C.I. No.5201), Phthalocyanine blue (C.I. No. 74160), Ultramarine blue (C.I. No. 77103).

The above coloring agents may be used alone or in combination of plural types. It is desirable that a coloring agent is present in a range from 1 to 20 parts by weight to 100 parts by weight of a monomer.

Charge controlling agent is used for controlling the toner frictional electrification property. According to the toner charging properties, there can be used either a positive or a negative one.

Examples of the positive charge controlling agent include an organic compound having a basic nitrogen atom such as basic dye, aminopyrine, a pyrimidine compound, a polynuclear polyamino compound, amino silanes; and a filler treated at the surface thereof with any of the compounds above-mentioned.

Examples of the negative charge controlling agent include an oil-soluble dye such as nigrosine base (CI5045), oil black (CI26150), Bontron S, spiron black and the like; a charge controlling resin such as a styrene-styrene sulfonate copolymer; a compound containing a carboxyl group (e.g., alkyl salicylic acid metal chelate) such as metallic complex dye; metallic soap of fatty acid; soap of resinate and metallic naphtenate, among others.

Charge controlling agent is present in a range of 0.1 to 10 parts by weight, preferably 0.5 to 8 parts by weight to 100 parts by weight of a monomer.

Offset inhibitor may be blended to give a toner an offset preventing effect.

Examples of the offset inhibitors include aliphatic hydrocarbon, aliphatic metallic salts, higher fatty acids, fatty esters or their partially saponified substances, silicone oil, a variety of waxes, among others. Most preferred is aliphatic hydrocarbon of which weight-average molecular weight is in the range of about 1000 to about 10000. Specifically, it is suitable to use, alone or in combination of plural types of.: low-molecular-weight polypropylene, low-molecular-weight polyethylene, paraffin wax, a low-molecular-weight olefin polymer comprising olefin units and having four or more carbon atoms, silicone oil, among others.

Offset inhibitor is present in a range of 0.1 to 10 parts by weight, preferably 0.5 to 8 parts by weight to 100 parts by weight of a monomer.

For ingredients capable of adding to the monomer-phase mixture, there are a magnetic powder, a crosslinking agent and the like.

By adding a magnetic powder, a magnetic toner for one-component developer is obtained.

The magnetic material is a substance strongly magnetized by a magnetic field in its direction. Therefore, the preferred is chemically stable magnetic powder of which particle size is not greater than 1 μm. Most preferred is fine powder of which particle size is in a range of about 0.01 to about 1 μm. Typical examples of the magnetic material include metal such ascobalt, iron, nickel, aluminum, copper, magnesium, tin, zinc, antimony, beryllium, bismuth, calcium, selenium, titanium, tungsten, vanadium, and a compound (i.e. oxide), an alloy or a mixture of the metal above-mentioned.

Magnetic powder is present in a range of 20 to 300 parts by weight, preferably 50 to 150 parts by weight to 100 parts by weight of a monomer.

Crosslinking agent is added to the crosslinking fixing resin to improve mechanical or thermal characteristics of the electrophotographic toner. The preferred ones are is the bifunctional and multifunctional monomers illustrated in connection with the cross-linking resin mentioned earlier.

The crosslinking agent is present in a range of 0.01 to 10 parts by weight, preferably 0.1 to 5 parts by weight to 100 parts by weight of a monomer.

In addition, a variety of additives such as a stabilizer may be present in a suitable proportion.

The following description will discuss another electrophotographic toner and a method of producing such toner in the present invention in which spherical toner particles are aggregated and deformed together with inorganic matter which is then chemically molten and removed.

The feature of this invention is that spherical toner particles are aggregated and deformed with inorganic matter intervening among the toner particles, and the inorganic matter is then chemically molten and removed to decompose the aggregate.

For the inorganic matter to be aggregated together with the spherical toner particles, the invention employs one which can be readily removed and dissolved by a chemical treatment, namely acid or alkali, that is conducted after the toner particles have been aggregated and deformed.

Examples of the inorganic matter include a variety of conventional compounds such as tribasic calcium phosphate, calcium sulfate, magnesium carbonate, barium carbonate, calcium carbonate, aluminum hydroxide, silicon dioxide, apatites, among others. These compounds may be used alone or in combination of plural types.

Tribasic calcium phosphate, calcium sulfate, magnesium carbonate, barium carbonate and apatites are dissolved in acid, while silicon dioxide is dissolved in alkali.

The following four manners are appropriate to make the inorganic matter intervene among toner particles:

(A) Toner particles and inorganic fine particles are blended at a predetermined ratio;

(B) Inorganic matter is chemically deposited on the surfaces of the toner particles;

(C) When producing toner particles by a suspension polymerization to be discussed later, inorganic fine particles are blended, causing the inorganic fine particles to attach to the surfaces of drops of a monomer-phase mixture dispersed in an aqueous dispersion medium; and (D) When producing toner particles by a suspension polymerization, an inorganic matter is chemically deposited on the surfaces of drops of a monomer-phase mixture being dispersed in an aqueous dispersion medium.

Among those, the manners (C) and (D) are limited to suspension polymerization, whereas the manner (A) or (B) is applicable to toner particles produced by any of the toner production methods including those produced by the suspension polymerization.

With the manner (B) or (D), the inorganic matter is deposited on the entire surface of the toner particles. This causes advantages that the toner particles are securely prevented from being welded to one another when aggregated.

To deposit an inorganic matter on the surfaces of toner particles or the surfaces of drops of a monomer-phase mixture, the following manners are appropriate.

Using one out of the inorganic matter above-mentioned that is dissolved in acid and is deposited by alkali, acid is firstly added to dissolve the organic matter, and alkali is then added in the presence of the toner particles or the drops of the monomer-phase mixture, causing the inorganic matter to be deposited.

Alternatively using one selected out of the inorganic matter above-mentioned that is solved in alkali and deposited by acid, alkali is added to dissolve the inorganic matter, and acid is then added in the presence of the toner particles or the drops of the monomer-phase mixture, causing the inorganic matter to be deposited.

It is required that the particle size of the fine particles of the inorganic matter used in the manner (A) or (C) is smaller than that of the toner particles, which preferably have not greater than about 10% of the particle size of the toner particles. If it exceeds the above range, the toner particles cannot uniformly be coated at the surfaces thereof with the inorganic fine particles. This involves the likelihood that the toner particles come in contact and are welded with one another.

The amount of the inorganic matter depends on the manner adopted. In either case, it is desired to use an ample amount of inorganic matter for uniformly coating the toner particles surfaces.

The following manners are appropriate to aggregate the spherical toner particles with the inorganic matter intervening thereamong.

(a) A manner by applying pressure with and without heating; or (b) A manner by heating, in the presence of water, toner particles and inorganic matter to a temperature not less than the glass transition temperature for a resin part of the toner particles.

The manner (b) is preferred.

With the manner (b), the toner particles heated to the glass transition temperature or more deform by capillary pressure produced when water entered the gaps among the toner particles is evaporated by heating. This enables to approximately equalize the degree of deformation for every toner particle.

In the manner (a), no particular restrictions are imposed on the pressure to be applied. The pressure depends on the degree of deformation, the type of fixing resin and the like, which is preferably in a range of 10 to 500 kg/cm$^2$ when pressing without heating. If it is below the above range, the toner particles might not sufficiently be aggregated and deformed. If it exceeds the range, the toner particles might be broken.

On the other hand, when pressing with heating, it is desirable that the pressure to be applied is in a range of about 0.1 to about 10 kg/cm$^2$ even though it varies with the degree of deformation, the type of fixing resin, the temperature applied during heating and the like. If it is below the above range, the toner particles might not sufficiently be aggregated and deformed. If it exceeds the range, the toner particles might be welded with one another, resulting in a unitary structure.

For pressing with heating, it is desirable that the temperature is raised, as in the manner (b), up to not less than the glass transition temperature for the resin part of the toner particles, in order to facilitate the deformation of the toner particles under the pressure above-mentioned.

Figure 2A:
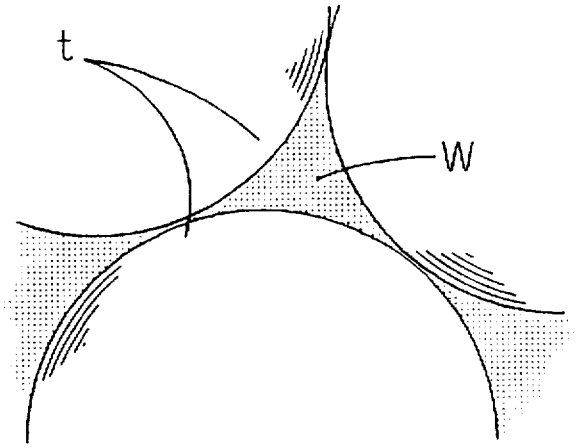
FIG. 2(*a*) to FIG. 2(*c*) are views schematically illustrating the steps of heating, aggregating and deforming spherical toner particles in the presence of water.
Figure 2B:
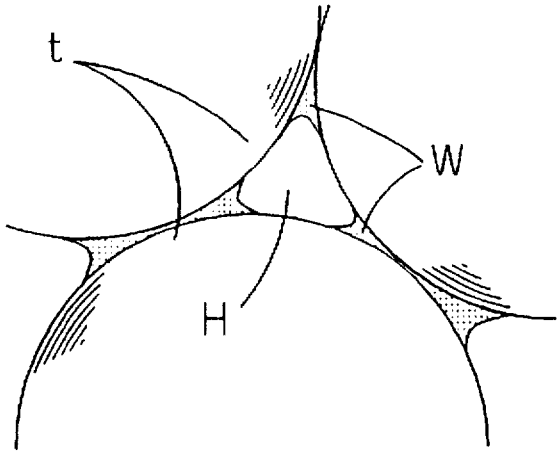
Figure 2C:
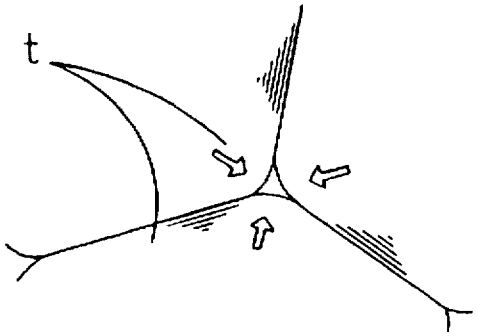

FIG. 2(*a*) to FIG. 2(*c*) illustrate, as a model case, the steps of aggregation to deformation of the toner particles in the toner particle aggregating manner (b). In FIGS. 2 (*a*) to 2 (*c*), the inorganic matter is not illustrated for the sake of convenience. As a matter of fact, the inorganic matter is deposited, in the form of a film, on the surface of toner particles t (if either the manner (B) or (D) is employed, or fine particles of the inorganic matter having a smaller particle size are present among the toner particles t (if either the manner (A) or (C) is employed).

When the toner particles t with water W entering the gaps thereamong (actually, in the form of a toner cake) is heated with the use of an oven or the like as shown in FIG. 2(*a*), the water W is evaporated to generate cavities H in the gaps among the toner particles as shown in FIG. 2(*b*).

When the cavities H are generated in the gaps among the toner particles t, the interfaces of the water W surrounding the cavities H which come in contact with the air, are curved, so that a capillary pressure (surface tension) is generated in such a direction as to shrink each of the interfaces.

Then, the toner particles, which are softened when heated, are aggregated and deformed as they are pulled in the directions shown by white arrows in FIG. 2(*c*).

The gaps among the toner particles t formed after the cavities H have been generated, communicate with one another. A decrease in the water W in the gaps among the toner particles t proceeds relatively uniformly. Further, the gaps among the toner particles communicating with one another, are filled with high-temperature vapor, allowing the heat to be quickly transmitted. Thus, with the manner (b), the degree of deformation for every toner particle is almost equalized. It is therefore possible to obtain more uniformly deformed electrophotographic toners compared with those obtained by the manner (a).

As apparent from the mechanism above-mentioned, the temperature for heating the toner-cake in the manner (b) is limited to a temperature not less than the glass transition temperature for the resin part of the toner particles. If the temperature applied during heating is below the glass transition temperature for the resin part, the toner particles cannot be aggregated and deformed by the mechanism above-mentioned.

When the aggregate in which the toner particles have been aggregated and deformed, is put in acid or alkali to chemically dissolve and remove the inorganic matter intervening among the toner particles, the aggregate is decomposed to produce a deformed electrophotographic toner. For accelerating the decomposition, the mixture may also be stirred.

The electrophotographic toner thus produced is excellent in cleaning properties with the use of a cleaning blade, yet assuring the advantages of the spherical toner particles, such as a narrower particle size distribution, reduced particle size and excellent flowability.

Particularly, an electrophotographic toner may also be produced using, as a raw material, toner particles obtained by a dispersion polymerization, to be discussed later. The resultant particle size distribution presents a toner particle distribution having a resemblance to a monodisperse. Accordingly, such a toner has outstanding characteristics in charging properties and image quality.

No particular restrictions are imposed on the particle size of the electrophotographic toner of the present invention. When using, as a raw material, toner particles produced by a suspension polymerization or a spray drying, to be discussed later, for a high-resolution image, it is desirable that the medium particle size is in a range of 4 μm to 20 μm, preferably around 10 μm, and the dispersion of particle size is not greater than 1.50, preferably not greater than 1.40.

When using, as a raw material, toner particles produced by a dispersion polymerization, a further reduction in particle size is realized, and the particle size distribution resembles a monodisperse. In this case, the medium particle size is in a range of 3 to 10 μm, preferably from 5 to 7 μm, and the particle size distribution is not greater than 1.30, preferably not greater than 1.20.

Spherical toner particles serving as a core of an electrophotographic toner comprise spherical particles of fixing resin and a variety of additives each being present in a predetermined amount.

The spherical toner particles may be produced by a variety of production methods, but the following manners are appropriate.

(1) A suspension polymerization method wherein there is prepared a liquid monomer-phase mixture containing a water-insoluble polymerizable monomer serving as a raw material of a fixing resin, a polymerization initiator soluble in the monomer above-mentioned, and a variety of additives. While suspended and dispersed, in the form of drops, in an aqueous dispersion medium such as water or the like, the monomer-phase mixture is heated to polymerize the monomer.

(2) A dispersion polymerization which comprises the steps of:

dissolving a polymerizable monomer serving as a raw material of a fixing resin, a polymerization initiator and a variety of additives, together with a dispersion stabilizer, in a medium in which the monomer is soluble but a polymer thereof is insoluble; and polymerizing the resulting solution under stirring.

(3) A spray drying comprising the steps of:

dissolving or dispersing a fixing resin and a variety of additives in a suitable solvent to prepare a spray and dry solution, and spraying the solution in the form of mist, while drying and removing the solvent.

The toner particles produced by each of the above three manners present a narrower particle size distribution, and can be reduced in particle size by changing the conditions. Accordingly, such toner particles are excellent in charging properties, and can produce high-quality images. Further, they do not call for classification, thus improving the productivity.

In particular, the particle size distribution of the spherical toner particles produced by the dispersion polymerization of the manner (2) show an approximate monodisperse, as previously described. Therefore, the present invention employs these spherical toner particles as the electrophotographic toner.

For the production method of the present invention, any of the toner particles produced by any of the manners (1), (2) or (3) is applicable. Besides those, spherical toner particles produced by other manners may be used.

For the monomer used in the manner (1) or (2) as a raw material of a fixing resin, a variety of radical polymerizable monomers are applicable.

For a fixing resin used in the manner (3), there can be used a variety of the polymeride of a monomer above-mentioned.

For the monomer, there can be used any of the monomers set forth in the foregoing.

The monomers can be used alone or in combination of plural types. In the case of producing a toner containing the most prevailing styrene-acrylic fixing resin, a styrene and an acrylic monomer may be jointly used as a monomer.

For the polymerization initiator for initiating the polymerization of the aforesaid monomer in the method (1) or (2), there be can used any of the compounds mentioned earlier. These compounds can be used alone or in combination of plural types.

For the polymerization initiator to be used in the suspension polymerization, there may suitably be selected, out of the compounds mentioned earlier, one which is insoluble in an aqueous dispersion medium, and is compatible with a monomer.

The polymerization initiator is present in a range of 0.001 to 10 parts by weight, preferably 0.01 to 0.5 parts by weight to 100 parts by weight of a monomer.

The polymerization can also be initiated using γ-rays, acceleration electron beams or the like. In such a case, polymerization initiator can be omitted. Alternatively, it may be conducted under a combination of ultraviolet rays and any of the photosensitizers.

For the coloring agents among the additives, any of the conventional coloring agents are applicable.

A predetermined amount of the coloring agent may previously be blended when producing toner particles by the manner (1), (2) or (3). Alternately, non-colored toner particles may first be produced by the manner (1), (2) or (3), and the toner particles thus produced may then be colored with a coloring agent before or after its deformation due to aggregation.

For a coloring agent to be previously blended with a monomer-phase mixture in the suspension polymerization, any of the coloring agents mentioned earlier is suitable. The coloring agents may be used alone or in combination of plural types. The preferred proportion is in a range of 1 to 20 parts by weight to 100 parts by weight of a monomer.

For a black toner, there is recommended carbon black, particularly a carbon black to which a surface treatment has been conducted to improve affinity for the monomer. Examples of such a surface treatment include a coupling treatment using a coupling agent, a grafting treatment using a monomer, among others.

For a coloring agent to be previously blended with a reaction system in a dispersion polymerization, a dye is used that readily dissolves in a monomer than in a medium, i.e. oil-soluble dye. The oil-soluble dye shifts from the medium to a polymer when the monomer decreases in number as the polymerization proceeds. This assures an effective dyeing.

The following illustrates examples of the oil-soluble dyes.

Black Dyes: Black FS-Special A, Black S, Black #103, Black #107, Black #215 and Black #141 (available under the trade name of CHUO GOSEI CHEMICAL CO., LTD.), OPLAS Black HZ, OPLAS Black #836 and OPLAS Black #838 (available under the trade name of ORIENT CHEMICAL INDUSTRIES, LTD.);

Red Dyes: MACROLEX Red 5B and MACROLEX Red Violet R (all manufactured by BAYER LTD.), Sumiplast Red AS, Sumiplast Red B-2 and Sumiplast Red HLG-Z (all available under the trade name of SUMITOMO CHEMICAL CO., LTD.), OPLAS Red RR and OPLAS Red #330 (available under the trade name of ORIENT CHEMICAL INDUSTRIES, LTD.), Red 6B and Red TR-71 (available under the trade name of CHUO GOSEI CHEMICAL CO., LTD.);

Orange Dyes: MACROLEX Orange 3G and MACROLEX Orange R (all available under the trade name of BAYER LTD.), Orange S, Orange R and Orange #826N (available under the trade name of CHUO GOSEI CHEMICAL CO., LTD.), OPLAS Orange PS and OPLAS Orange PR (available under the trade name of ORIENT CHEMICAL INDUSTRIES, LTD.), Sumiplast Orange HRP (available under the trade name of SUMITOMO CHEMICAL CO., LTD.);

Yellow Dyes: MACROLEX Yellow 6G and MACROLEX Yellow R (all available under the trade name of BAYER LTD.), Yellow D, Yellow GE and Yellow #189 (available under the trade name of CHUO GOSEI CHEMICAL CO., LTD.), Sumiplast Yellow GC and Sumiplast Yellow R (all available under the trade name of SUMITOMO CHEMICAL CO., LTD.), OPLAS Yellow 3G and OPLAS Yellow #130 (all available under the trade name of ORIENT CHEMICAL INDUSTRIES, LTD.);

Violet Dyes: MACROLEX Violet 3R and MACROLEX Violet B (all available under the trade name of BAYER LTD.), Violet MVB (available under the trade name of CHUO GOSEI CHEMICAL CO., LTD.), Sumiplast Violet RR and Sumiplast Violet B (available under the trade name of SUMITOMO CHEMICAL CO., LTD.), OPLAS Violet #370 and OPLAS Violet #732 (all available under the trade name of ORIENT CHEMICAL INDUSTRIES, LTD.);

Blue Dyes: MACROLEX Blue RR (available under the trade name of BAYER LTD.), Blue BO and Blue #8B (available under the trade name of CHUO GOSEI CHEMICAL CO., LTD.); Sumiplast Blue OR, Sumiplast Blue GP and Sumiplast Blue S (available under the trade name of SUMITOMO CHEMICAL CO., LTD.), OPLAS Blue IIN and OPLAS Blue #630 (all available under the trade name of ORIENT CHEMICAL INDUSTRIES, LTD.);

Green Dyes: MACROLEX Green 5B and MACROLEX Green G (all available under the trade name of BAYER LTD.), Green #550 and Green #201 (available under the trade name of CHUO GOSEI CHEMICAL CO., LTD.), Sumiplast Green G (available under the trade name of SUMITOMO CHEMICAL CO., LTD.), OPLAS Green #502 and OPLAS Green #503 (available under the trade name of ORIENT CHEMICAL INDUSTRIES, LTD.);

Brown Dyes: Brown PB and Brown SG (available under the trade name of CHUO GOSEI CHEMICAL CO., LTD.), OPLAS Brown #430 and OPLAS Brown #431 (available under the trade name of ORIENT CHEMICAL INDUSTRIES, LTD.).

The amount of the respective oil-soluble dye depends on the degree of a desired coloring density. Normally, it is desired to use an oil-soluble dye in an amount of 1 to $10^{-9}$ times, more preferably $10^{-6}$ times, in terms of weight ratio per unit of a reaction solution.

For a coloring agent to be previously blended with a solution in the spray drying, any of the coloring agents above-mentioned are applicable.

In the case of dyeing non-colored toner particles after they are produced, non-colored toner particles may be dispersed, together with dispersible dye or the like, in an aqueous dispersion medium, and the resulting solution may then be stirred at a predetermined temperature for a predetermined period of time.

Examples of the dispersible dye used for dyeing include azo dye, anthraquinone dye, indigoid dye, sulfur dye, phthalocyanine dye, which preferably has a higher affinity for a polymer forming toner particles such that the toner particles are sufficiently dyed. The amount of the dispersible dye depends on the degree of a desired coloring density. Normally, it is preferable that a dispersible dye is present in an amount not less than 2% by weight, preferably not less than 4% by weight, for toner particles.

For an aqueous medium, water is normally used. If both of the toner particles and the dye are poor in dispersibility, a small amount of a suitable organic solvent may be added. The aqueous medium is present in an amount of not less than 500 parts by weight to 100 parts by weight of the toner particles.

For other typical additives than the coloring agent, there are charge controlling agent, offset preventing agent, magnetic powder and crosslinking agent mentioned earlier.

Charge controlling agent is present in an amount of 0.1 to 10 parts by weight, preferably 0.1 to 8 parts by weight to 100 parts by weight of a monomer.

Offset preventing agent is present in an amount of 0.1 to 10 parts by weight, preferably 0.5 to 8 parts by weight to 100 parts by weight of a monomer.

Magnetic powder is present in an amount of 20 to 300 parts by weight, preferably 50 to 150 parts by weight to 100 parts by weight of a monomer.

Crosslinking agent is present in an amount of 0.01 to 10 parts by weight, preferably 0.1 to 5 parts by weight to 100 parts by weight of a monomer.

In addition, a variety of additives such as a stabilizer may be blended in a suitable amount.

In the suspension polymerization of the manner (1), for the aqueous dispersion medium in which a monomer-phase mixture containing the ingredients above-mentioned is to be dispersed in the form of drops, there may be used water or a mixed solvent mainly including water, which is particularly incompatible with the monomer in the monomer-phase mixture. Most preferred is water.

To stabilize the dispersibility of the monomer-phase drops, it is desired to blend, with the aqueous dispersion medium, a dispersion stabilizer or a surfactant selected from the examples as previously mentioned.

In the dispersion polymerization of the manner (2), solvents in which a monomer is soluble but a polymer thereof is insoluble, include water; lower alcohols such as methyl alcohol, ethyl alcohol, isopropyl alcohol and the like; polyols such as ethylene glycol, propylene glycol, butanediol, diethylene glycol, triethylene glycol; cellosolvs such as methyl cellosolv, ethyl cellosolv; ketones such as acetone, methylethyl ketone; ethers such as tetrahyldrofuran and esters such as ethyl acetate, among others.

These examples may be used alone or in combination of plural types. The preferred ones are lower alcohols such as ethanol, water, and a mixture solvent containing water and lower alcohol. For this mixed solvent, it is desired that the ratio by weight of water to lower alcohol is in a range from 40:60 to 5:95, preferably from 30:70 to 10:90. The preferred amount of the solvent is in a range from 50 to 5000 parts by weight, preferably 500 to 2500 parts by weight to 100 parts by weight of a monomer.

Examples of the dispersion stabilizer for stabilizing the dispersibility of a polymer in a solvent, include polyacrylic acid, polyacrylate, polymethacrylic acid, polymethacrylate, a (meth)acrylic acid-(meth)-acrylate ester copolymer, an acrylic acid-vinyl ether copolymer, a methacrylic acid-styrene copolymer, carboxy-methylcellulose, a poly (hydroxystearic acid-g-methyl methacrylate-co-methacrylic acid) copolymer, polyethylene oxide, polyacrylamide, methyl cellulose, ethyl cellulose, hydroxyethyl cellulose, polyvinyl alcohol, among others.

Besides, there can be employed a nonionic surfactant, an anionic surfactant, a cationic surfactant, an ampholytic surfactant or the like. It is desirable to use a dispersion stabilizer in an amount of 0.1 to 30 parts by weight, preferably 1 to 10 parts by weight to 100 parts by weight of a monomer.

In the spray drying of the manner (3), for a solvent in which the ingredients above-mentioned are dissolved, there may be selected, from a variety of conventional organic solvents, one that can dissolve a fixing resin. The concentration of solid matter in a solution for spray-drying may be equivalent to that of a conventional one.

EXAMPLES

The following description will embody the present invention with reference to various Examples and Comparative Examples.

Example 1

Synthesis of Fine Particles of Crosslinking Resin

A 1-liter-separable flask substituted with nitrogen was charged with 500 parts by weight of methanol as a solvent, 50 parts by weight of divinyl benzene as a polymerizable monomer, 6 parts by weight of polymethacrylate as a dispersion stabilizer and 5 parts by weight of 2,2'-azobisisobutyronitrile as a polymerization initiator, thereby to prepare a continuous phase to be subjected to dispersion polymerization. The continuous phase was heated up to a temperature of 65° C. under stirring at 100 r.p.m., and was subjected to a polymerization reaction for 18 hours. The resulting polymerized particles were filtered off, washed several times with a methanol and then dried to give fine particles of crosslinking resin.

The primary particle size of the fine particles of crosslinking resin was 1.2 μm as calculated from an electron micrograph (to be described later) of the electrophotographic toner T later produced.

Production of Electrophotographic Toner

Together with the following ingredients, 5 parts by weight of carbon black and 20 parts by weight of the fine particles of the aforesaid crosslinking resin were sufficiently mixed and dispersed using a ball mill. To the resulting mixture, 2 parts by weight of 2,2'-azobis(2,4-dimethyl valeronitrile) as a polymerization initiator was added to prepare a monomer-phase mixture for a suspension polymerization.

| Ingredients | Parts by Weight |
|---|---|
| Monomer: | |
| Styrene | 80 |
| 2-Ethylhexyl methacrylate | 20 |
| Charge Controlling Agent: | |
| Styrene sodium sulfonate | 1 |
| Release Agent: | |
| Low-molecular-weight polypropylene | 1 |
| Crosslinking Agent: | |
| Divinylbenzene | 1 |

As a dispersion stabilizer, 0.1 part by weight of sodium dodecylbenzenesulfonate and 5 parts by weight of tribasic calcium phosphate, 100 parts by weight of the monomer-phase mixture and 400 parts by weight of a refined water were stirred at 7000 r.p.m for 20 minutes with the use of a high-speed stirrer (Model TK Homo-mixer manufactured by Tokushukika Kogyo Co., Ltd.), thereby to give a suspension in which the average particle size of the drops was 10 μm. While stirring under nitrogen atmosphere at 100 r.p.m., the suspension was heated to 70° C., and was subjected to a polymerization reaction for 10 hours. The resulting polymerized particles were filtered off, washed several times with a refined water and then dried, thus giving an electrophotographic toner of which the average particle size was 10 μm.

Figure 3A:
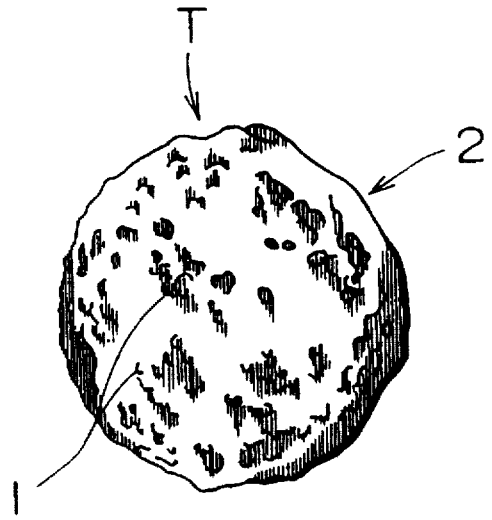
FIG. 3(*a*) is a front view illustrating the external appearance of a particle of an electrophotographic toner prepared in Example 1 of the present invention, FIG. 3(*b*) is a front view illustrating the external appearance of a particle of an electrophotographic toner prepared in Comparative Example 1, and FIG. 3(*c*) is a front view illustrating the external appearance of a particle of an electrophotographic toner prepared in Comparative Example 2.
Figure 3B:
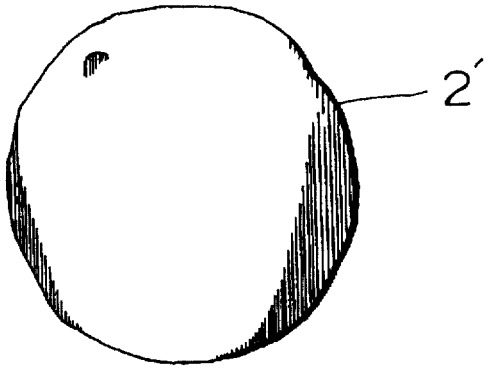
Figure 3C:
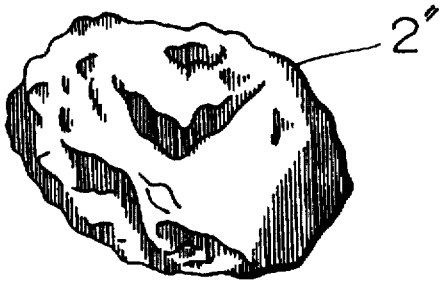

The electrophotographic toner T thus obtained was observed with an electron microscope, and confirmed that a toner particle 2 was almost spherical and it was that numerous projections of fine particles of crosslinking resin 1 were formed on the surface of the toner particle 2, as shown in FIG. 3(*a*).

Comparative Example 1

By suspension polymerization, electrophotographic toner having the average particle size of 10 μm was prepared in the same manner as in Example 1 except that no fine particles of crosslinking resin were blended.

The electrophotographic toner thus obtained was observed with an electron microscope, and it was confirmed that a toner particle 2' was almost spherical and that no projections were formed on the surface of the toner particle 2', as shown in FIG. 3(*b*).

Comparative Example 2

70 parts by weight of styrene and 30 parts by weight of butyl methacrylate as monomers, and 2 parts by weight of ethylene glycol dimethacrylate as a crosslinking agent, were mixed to prepare a solution. This solution was emulsion-polymerized by a soap-free emulsion polymerization that employs potassium persulfate as a polymerization initiator, thus obtaining fine particles of crosslinking resin of which the average particle size was 2 μm and of which the degree of crosslinking was relatively low.

By suspension polymerization, an electrophotographic toner having the average particle size of 10 μm was prepared in the same manner as in Example 1 except for the use of 200 parts by weight of the fine particles of crosslinking resin thus obtained.

The electrophotographic toner thus obtained was observed with an electron microscope, and it was confirmed that a toner particle 2" had an indeterminate shape as shown in FIG. 3(*c*).

Each of the electrophotographic toners prepared in Example 1 and Comparative Examples 1 and 2 was mixed with a ferrite carrier to prepare a two-component developer having a toner concentration of 3% by weight. With each two-component developer, using for an electrostatic copying apparatus [Model DC-1205 manufactured by Mita Industrial Co., Ltd.], each electrophotographic toner was evaluated for cleaning properties and fixing properties.

Figure 4:
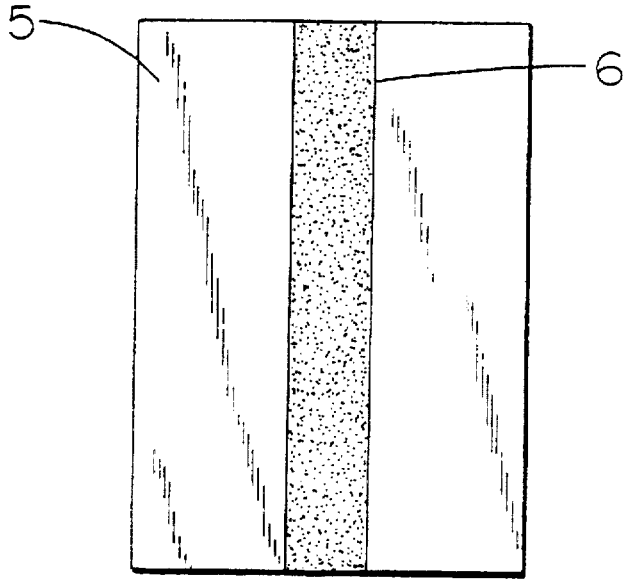
FIG. 4 is a front view of a document image to be used for evaluating the cleaning properties for the respective electrophotographic toners prepared in certain in Examples and Comparative Examples.

Test of Cleaning Properties As shown in FIG. 4, there was used a document of a A3-size white paper sheet 5 to which a 30 mm-wide strip 6 having a Munsell value N2.0 was attached. With no paper for image transfer supplied to the electrostatic copying apparatus, the apparatus was started for a copying operation and its power supply was cut before the cleaning step was completed. Then, the photoreceptor drum was taken out.

Figure 5:
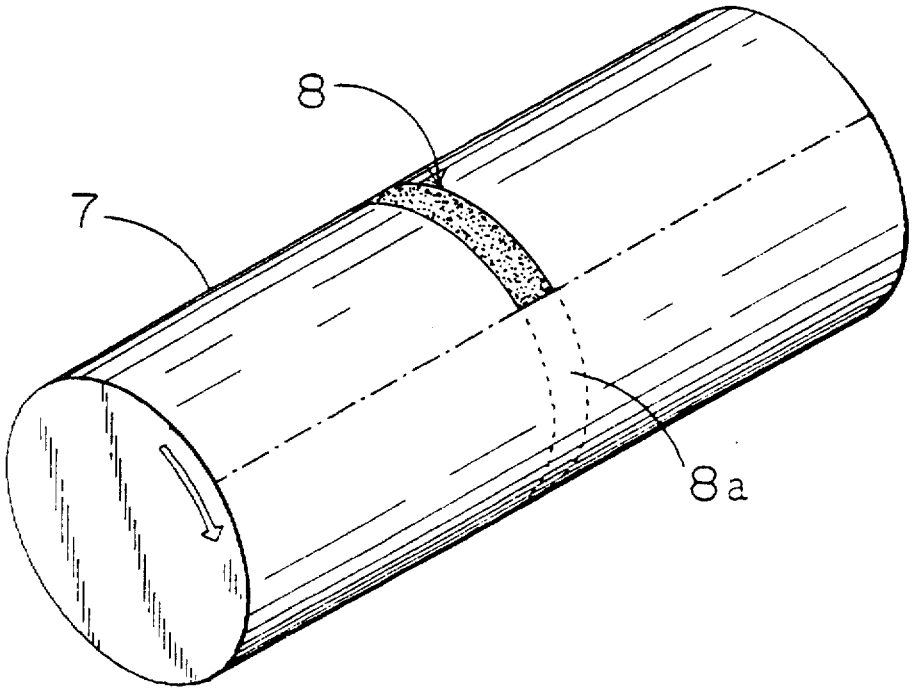
FIG. 5 is a perspective view of a photoreceptor drum taken out from an electrostatic copying apparatus in order to evaluate, using the document image in FIG. 4, cleaning properties for the respective electrophotographic toners.

Referring to FIG. 5, a photoreceptor drum 7 has, on the surface thereof, a toner image corresponding to the document above-mentioned, and the toner image has a portion 8 corresponding to the strip 6. In the portion 8, a cleaning blade contact position is shown by a chain line. A pressure-sensitive adhesive tape was attached to the surface of a portion 8*a* (shown by broken lines) cleaned by the cleaning blade, the portion 8*a* being located downstream in the rotation direction of the photoreceptor drum 7 (shown by a white arrow in FIG. 5) with respect to the cleaning blade contact position above-mentioned.

Then, the pressure-sensitive adhesive tape was separated from the surface of the photoreceptor drum 7 and then attached to the surface of a white paper sheet. The density on the adhesive tape was measured using a reflection densitometer (Model TC-6D manufactured by Tokyo Denshoku Co., Ltd.) for evaluation of the cleaning properties. The density at the time when no toner remained on the surface of the photoreceptor drum, is in a range of 0.10 to 0.14. If the density becomes not less than 0.2, it is evaluated that toner remained.

The results are shown in Table 1.

TABLE 1

| | Example 1 | Comparative Example 1 | Comparative Example 2 |
|---|---|---|---|
| Density | 0.130 | 0.691 | 0.212 |
| Judgement | No toner remaining | Toner remaining | Toner slightly remaining |

The following observations were noted by inspection of the results in Table 1.

The spherical electrophotographic toner provided on the surface thereof with no projections (Comparative Example 1) was very poor in cleaning properties, and remained in a great amount on the surface of the photoreceptor drum.

The non-spherical electrophotographic toner having an indeterminate shape (Comparative Example 2) had cleaning properties superior to that of the toner of Comparative Example 1, but a slight amount of toner remained on the surface of the photoreceptor drum.

On the other hand, the electrophotographic toner of the invention (Example 1) was excellent in cleaning properties, and hardly remained on the surface of the photoreceptor drum.

Test of Fixing Properties

With paper for image transfer supplied to the electrostatic copying apparatus, a document identical with that used in the test of cleaning properties was copied by the apparatus. A black solid portion 9 of each reproduced image which corresponds to the strip, was cut away and attached to the surface of a board 10 as shown in FIG. 6(*a*).

Figure 6A:
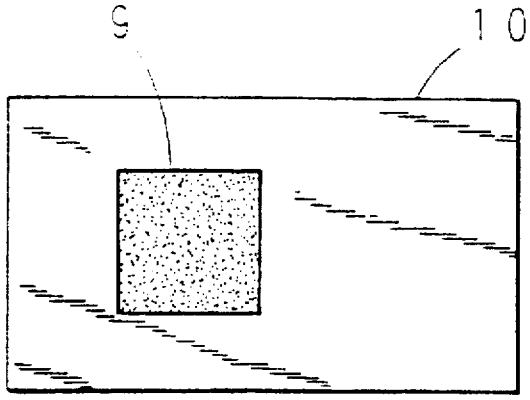
FIG. 6(*a*) to FIG. 6(*c*) are views successively illustrating a method of evaluating fixing properties for the respective electrophotographic toners prepared in certain Examples and Comparative Examples.
Figure 6B:
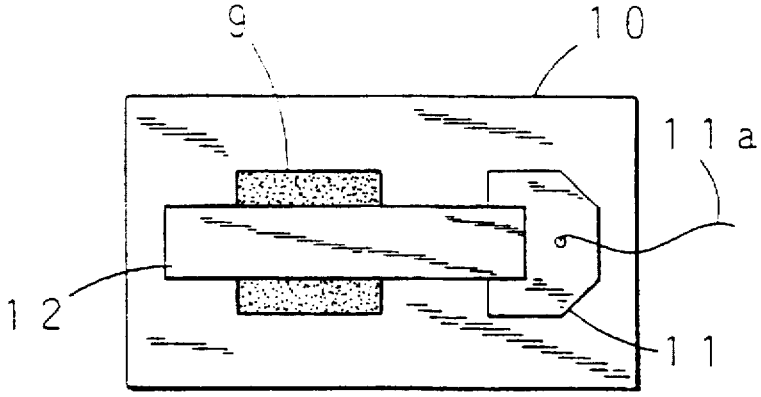
Figure 6C:
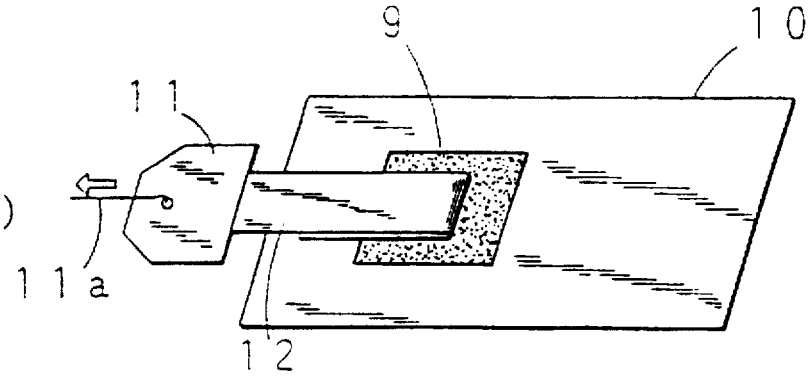

As shown in FIG. 6(*b*), a pressure-sensitive adhesive tape 12 (a white tweed tape manufactured by Rinrei Co., Ltd.) provided at one end thereof with a picker 11, was placed on the black solid portion 9 with the adhesive surface turned down. The board 10 was then passed through a pressing roller (its own weight of 1467 g, a width of 150 mm, a diameter of 40 mm, a peripheral speed of 9.68 mm/second) of a fixing-rate evaluation testing machine (manufactured by Mita Industries Co., Ltd.). The weight of the pressing roller caused the pressure-sensitive adhesive tape 12 to be stuck to the surface of the black solid portion 9, thus preparing a sample for a test of fixing properties. In FIG. 6(*b*), the picker 11 has a separating string 11*a*.

Then, the sample was placed on a sample fixing stand of the fixing-rate evaluation testing machine. One end of the board 10 at the right side in FIG. 6 was fixed with a fixing tool of the sample fixing stand, and the string 11*a* of the picker 11 was attached to a lifting gear of the fixing-rate evaluation testing machine. Then, the string 11*a* was pulled in the direction shown by a white arrow in FIG. 6(*c*) by the rotation of the lifting gear, such that the pressure-sensitive adhesive tape 12 was separated by an angle of 180° C. at a speed of 1 mm/second.

The image density $D_2$ for the part of the black solid portion 9 to and from which the pressure-sensitive adhesive tape 12 had been attached and then separated, was measured with the reflection densitometer mentioned earlier. From the value thus obtained and the obtained value of an image density $D_1$ for the same part before the pressure-sensitive adhesive tape 12 had been attached thereto, the fixing rate was obtained according to the following equation for evaluating the fixing properties.

Fixing rate (%)$=D_2/D_1\times100$

The results are shown in Table 2

TABLE 2

| | Example 1 | Comparative Example 1 | Comparative Example 2 |
|---|---|---|---|
| Fixing Rate | 93% | 98% | 52% |

The following observations were noted by inspection of the results in Table 2.

The electrophotographic toner containing a great amount of crosslinking resin (Comparative Example 2) exhibited an extremely low fixing rate and therefore it was very poor in fixing properties.

On the other hand, Example 1 presented a fixing rate equivalent to that of Comparative Example 1 containing no crosslinking resin, thus being excellent in fixing properties.

Example 2

While dispersing 10 parts by weight of silica powder as inorganic fine particles being water-insoluble, in 300 parts by weight of methanol, 2% by weight of a titanate-type coupling agent was added to the silica powder. The reaction system was stirred at room temperature for 3 hours such that the silica powder was subjected to a coupling treatment. The reaction system was then centrifuged to separate the silica powder, and the silica powder was then dried.

The primary particle size of the silica powder thus treated was 0.5 μm as measured from an electron micrograph of the electrophotographic toner later produced.

Together with the following ingredients, 5 parts by weight of the above silica powder and 5 parts by weight of carbon black were sufficiently mixed and dispersed using a ball mill. To the resulting mixture, there was added 2 parts by weight of 2,2'-azobis(2,4-dimethyl valeronitrile) as a polymerization initiator, thereby preparing a monomer-phase mixture for a suspension polymerization.

| Ingredients | Parts by weight |
|---|---|
| Monomer: | |
| Styrene | 80 |
| 2-Ethylhexyl methacrylate | 20 |
| Release Agent: | |
| Low-molecular-weight polypropylene | 1 |
| Crosslinking Agent: | |
| Divinylbenzene | 1 |

The monomer-phase mixture was gently added to a refined water serving as an aqueous dispersion medium and allowed to stand for a while. Then, the interface was watched, and it was observed that when fine particles 1 (silica powder) settled from the monomer-phase mixture 3 into the aqueous dispersion medium 4 (refined water) as shown by a white arrow in FIG. 7(*a*), each set of two or three fine particles aggregated with one another and, settled with a portion 31 of the monomer-phase mixture 3 pulled to the periphery thereof. From this, it was confirmed that the silica powder treated with a coupling agent improved in affinity for the monomers.

Together with 0.1 part by weight of sodium dodecylbenzenesulfonate and 5 parts by weight of tribasic calcium phosphate as a dispersion stabilizer, 100 parts by weight of the monomer-phase mixture and 400 parts by weight of refined water were stirred at 8000 r.p.m. for 20 minutes with the use of the high-speed stirrer mentioned earlier, thereby to prepare a suspension in which the average particle size of the drops was 10 μm.

While stirred under nitrogen atmosphere at 100 r.p.m., the suspension was heated to 80° C., and was subjected to a polymerization reaction for 10 hours. The resulting polymerized particles were filtered off, washed several times with a refined water and then dried, thus giving an electrophotographic toner of which the average particle size was 10 μm.

The electrophotographic toner T thus obtained was observed with an electron microscope, and it was confirmed that the toner had a shape substantially identical with that of Example 1.

Example 3

While 5 parts by weight of silica powder as inorganic fine particles being insoluble in water was mixed with and dispersed in 80 parts by weight of styrene as a monomer, 0.6 part by weight of 2,2'-azobis(2,4-dimethyl valeronitrile) serving as a polymerization initiator was added to the resulting mixture. While stirring at 200 r.p.m. under nitrogen atmosphere, the reaction system was heated to 70° C., and was subjected to a polymerization reaction for one hour such that the silica powder was grafted.

The primary particle size of the silica powder thus grafted was 0.6 μm as measured from an electronmicrograph of the electrophotographic toner later produced.

Together with the following ingredients, the entire amount of the dispersion of the grafted silica powder and 5 parts by weight of carbon black, were sufficiently mixed and dispersed using a ball mill. To the resulting mixture, there was added 2 parts by weight of 2,2'-azobis(2,4-dimethyl valeronitrile) as a polymerization initiator, thereby preparing a monomer-phase mixture to be subjected to a suspension polymerization.

| Ingredients | Parts by weight |
|---|---|
| Monomer: | |
| 2-Ethylhexyl methacrylate | 20 |
| Release Agent: | |
| Low-molecular-weight polypropylene | 1 |
| Crosslinking Agent: | |
| Divinylbenzene | 1 |

Figure 7A:
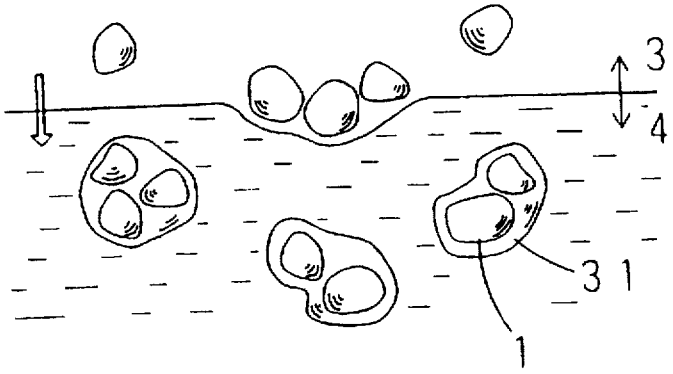
FIG. 7(*a*) is a schematic view illustrating how to settle, at the interface between a monomer-phase mixture and an aqueous dispersion medium, inorganic fine particles which have been treated to increase affinity for the monomer, and FIG. 7(*b*) is a schematic view illustrating how to settle inorganic fine particles which have not been subjected to the treatment above-mentioned.
Figure 7B:
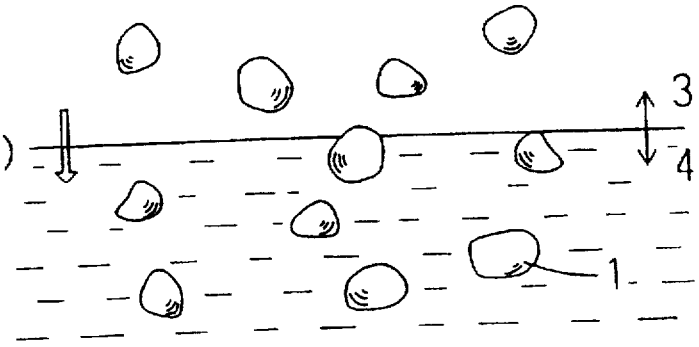

The monomer-phase mixture was gently added to a refined water serving as an aqueous dispersion medium and allowed to stand for a while. The interface was watched and it was observed that, as shown in FIG. 7(*a*), each set of two or three fine particles 1 aggregated with one another, settled with a portion 31 of the monomer-phase mixture 3 pulled to the periphery thereof, as in Example 2. From this, it was confirmed that the grafted silica powder also improved in affinity for the monomer.

Together with 0.1 part by weight of sodium dodecylbenzenesulfonate and 5 parts by weight of tribasic calcium phosphate as a dispersion stabilizer, 100 parts by weight of the monomer-phase mixture and 400 parts by weight of refined water were stirred at 8000 r.p.m. for 20 minutes with the use of the high-speed stirrer mentioned earlier, thereby to prepare a suspension in which the average particle size of drops was 10 μm.

Then, there was obtained an electrophotographic toner having the average particle size of 10 μm in the same manner as in Example 2 except for the use of this suspension.

The electrophotographic toner thus obtained was observed with an electron microscope, and it was confirmed that the toner had a shape substantially identical with that of Example 1 or 2.

Comparative Example 3

There was prepared a monomer-phase mixture for a suspension polymerization in the same manner as in Example 2, except that tribasic calcium phosphate was not treated with a titanate-type coupling agent.

The monomer-phase mixture was gently added to a refined water serving as an aqueous dispersion medium and allowed to stand for a while. The interface was observed, and it was confirmed that, as shown in FIG. 7(*b*), fine particles 1 (silica powder) settled, as they were, from the monomer-phase mixture 3 to an aqueous dispersion medium 4 (refined water). From this, it was confirmed that the silica powder which had not been treated with a coupling agent, was poor in affinity for the monomer.

Then, the monomer-phase mixture was subjected to suspension polymerization in the same manner as in Example 2 or 3, thus preparing an electrophotographic toner having the average particle size of 10 μm.

The electrophotographic toner thus obtained was observed with an electron microscope, and it was confirmed that the toner was almost spherical having no projections as in Comparative Example 1. This showed that with the use of untreated silica powder, no projections could be formed on the surfaces of the toner particles.

Each of the electrophotographic toners prepared in Examples 2, 3 and Comparative Example 3, was mixed with a ferrite carrier to prepare a two-component developer having a toner concentration of 3% by weight. With each two-component developer using for an electrostatic copying apparatus [Model DC-1205 manufactured by Mita Industrial Co., Ltd.], the cleaning test mentioned earlier was conducted for evaluating the cleaning properties.

The results are shown in Table 3.

TABLE 3

| | Example 2 | Example 3 | Comparative Example 3 |
|---|---|---|---|
| Density | 0.125 | 0.135 | 0.652 |
| Judgement | No toner remaining | No toner remaining | Toner remaining |

The following observations were noted by inspection of the results in Table 3.

The spherical electrophotographic toner provided on the surface thereof with no projections (Comparative Example 3) was very poor in cleaning properties, and toner remained in a great amount on the surface of the photoreceptor drum.

On the other hand, the electrophotographic toner of Example 2 or 3 was excellent in cleaning properties, and hardly any toner remained on the surface of the photoreceptor drum.

Example 4

Production of Spherical Toner

Together with the following ingredients, 100 g of grafted carbon black (containing 40% by weight of styrene) produced by treating carbon black with a styrene monomer was stirred at 100 r.p.m. for 10 minutes with the high-speed stirrer, thus preparing a monomer-phase mixture.

| Ingredients | (g) |
|---|---|
| Monomer: | |
| Styrene | 400 |
| Ethyl acrylate | 120 |
| Crosslinking Agent: | |
| Divinylbenzene | 0.5 |
| Polymerization Initiator: | |
| Benzoyl peroxide | 12 |
| Polymerization Adjusting Agent: | |
| t-Dodecyl mercaptan | 1 |
| Charge Controlling Agent: | |
| Bontron S-34 | 5 |

The monomer-phase mixture was mixed with 2000 g of an ion exchange water serving as an aqueous dispersion medium and 65 g of polyvinyl alcohol as a dispersion stabilizer. The resulting mixture was stirred at 10000 r.p.m. for 30 minutes with the high-speed stirrer mentioned earlier, thereby to prepare a suspension in which the average particle size of the drops was 10 μm.

The suspension was transferred to a 3-liter-separable flask having a stirrer, a nitrogen inlet tube and a condenser. While stirring under nitrogen atmosphere, the suspension was heated to 75° C. and subjected to a polymerization reaction for 8 hours. The resulting polymerized particles were filtered off, washed several times with a refined water and then dried to give toner particles.

The average particle size of the toner particles thus obtained was 10 μm as measured with a coulter counter.

Figure 8A:
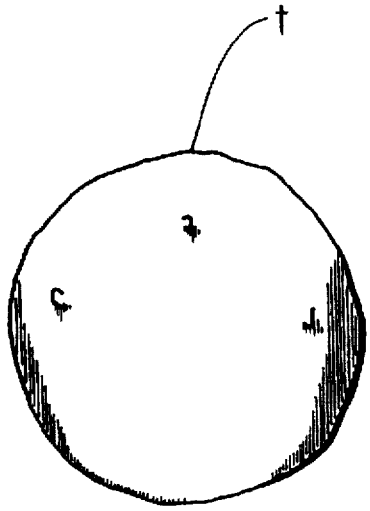
FIG. 8(*a*) is a front view illustrating the external appearance of a spherical toner particle prepared in Example 4 of the present invention, and FIG. 8(*b*) is a front view illustrating the external appearance of an electrophotographic toner particle obtained by deforming the spherical toner particle in FIG. 8(*a*)
Figure 8B:
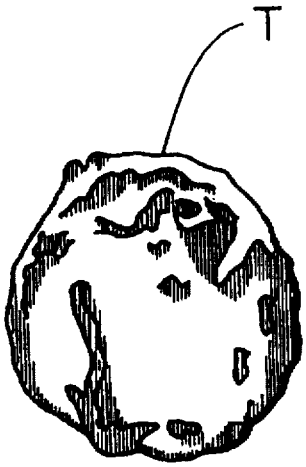

The toner particles were observed with an electron microscope, and it was confirmed that a toner particle t was almost spherical as shown in FIG. 8(*a*).

Deformation of Toner Particles

Then, 100 g of the spherical toner particles thus obtained was mixed with 50 g of sodium chloride powder (having a particle size of about 1 μm) as inorganic fine particles. The resulting mixture was pressed under a pressure of 200 kg/cm$^2$ with a hydraulic press, thus causing the mixture to be aggregated.

The aggregate was put in a great amount of water and stirred with a domestic mixer to dissolve and remove the sodium chloride, thus decomposing the aggregate into pieces. The pieces thus decomposed were filtered off, washed with ion exchange water and then dried, thus giving a deformed electrophotographic toner.

The electrophotographic toner thus obtained was observed, and it was and confirmed that the toner T was deformed as shown in FIG. 8(*b*).

Figure 9:
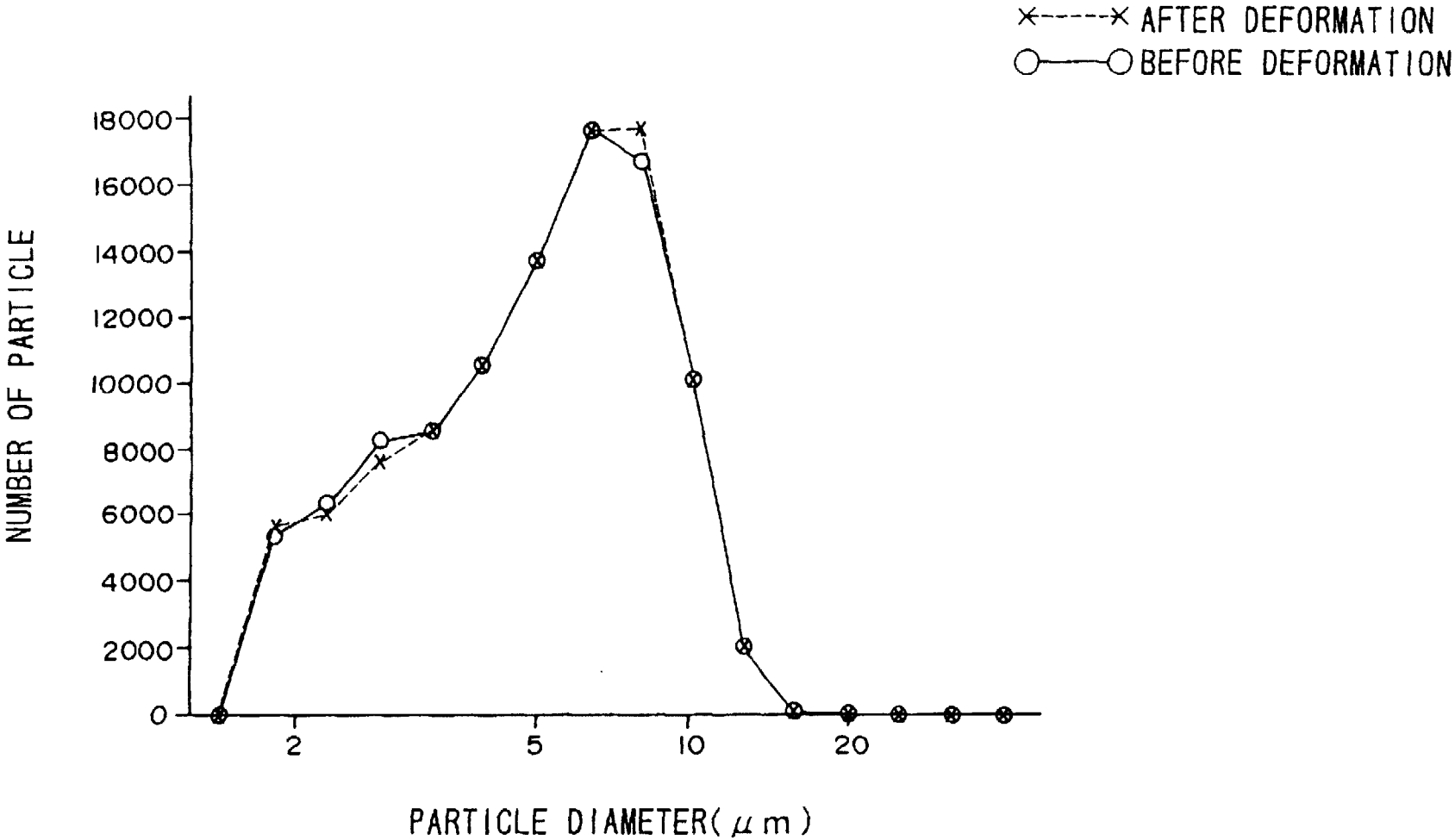
FIG. 9 is a graph of the particle size distributions of the spherical toner particles and the deformed electrophotographic toner particles in Example 4.

The particle size distribution of the electrophotographic toner thus obtained was measured by a coulter counter. FIG. 9 shows the results. As shown by a broken line in FIG. 9, the particle size of the deformed toner is substantially the same as that of the toner before deformation (shown by a solid line in FIG. 9). Thus, it was confirmed that the particle size distribution did not change due to the deformation treatment.

Example 5

The following ingredients were stirred at 100 r.p.m. for 10 minutes with the high-speed stirrer mentioned earlier to prepare a monomer-phase mixture.

| Ingredients | (g) |
|---|---|
| Monomer: | |
| Styrene | 500 |
| 2-Ethylhexyl-methacrylate | 120 |
| Crosslinking Agent: | |
| Divinylbenzene | 1 |
| Coloring Agent: | |
| Carbon black | 30 |
| Coupling Agent: | |
| Methyl Trimethoxysilane | 3 |
| Polymerization Initiator: | |
| 2,2'-Azobisisobutyronitrile | 12 |
| Polymerization Adjusting Agent: | |
| t-Dodecyl mercaptan | 3 |
| Charge Controlling Agent: | |
| Azo Oil black | 5 |

The monomer-phase mixture was mixed with 2000 g of an ion exchange water serving as an aqueous dispersion medium and 40 g of silica sol as inorganic fine particles (having a particle size of about 0.2 μm). The resulting mixture was stirred at 10000 r.p.m. for 30 minutes with the high-speed stirrer mentioned earlier, thereby preparing a suspension in which the average particle size of the drops was 10 μm.

The suspension was subjected to a polymerization reaction under conditions similar to those in Example 4. The reaction solution was split off using a Buchner funnel and a suction bottle, and then dried to give toner particles.

The average particle size of the toner particles thus obtained was 10 μm as measured with a coulter counter.

The toner particles were observed with an electron microscope, and confirmed that the toner particles were almost spherical and it was that a large number of silica fine particles were attached to the surface of the toner particles.

Deformation of Toner Particles

The spherical toner particles thus obtained were pressed under a pressure of 200 kg/cm$^2$ with a hydraulic press, thus causing the toner particles to be aggregated.

The resulting aggregate was put in an aqueous solution of 4N sodium hydroxide and stirred with a domestic mixer to dissolve and remove the silica fine particles, thus decomposing the aggregate into pieces. The pieces thus decomposed were filtered off, washed with ion exchange water and then dried, thus giving a deformed electrophotographic toner.

The electrophotographic toner thus obtained was observed, and it was confirmed that the toner was deformed as in Example 4.

The particle size distribution of the electrophotographic toner thus obtained was measured in the same manner as in Example 4. From the results, it was confirmed that the particle size distribution did not substantially change due to the deformation treatment.

Comparative Example 4

The aggregate of sodium chloride powder and toner particles obtained in the Deformation of Toner Particles of Example 4, was coarsely crushed and then disintegrated with a supersonic-speed jet mill (Model IDS2 manufactured by Japan Pneumatic Kogyo Co., Ltd.) until the particle size became about 10 μm. Thus, a deformed electrophotographic toner was prepared.

Figure 10:
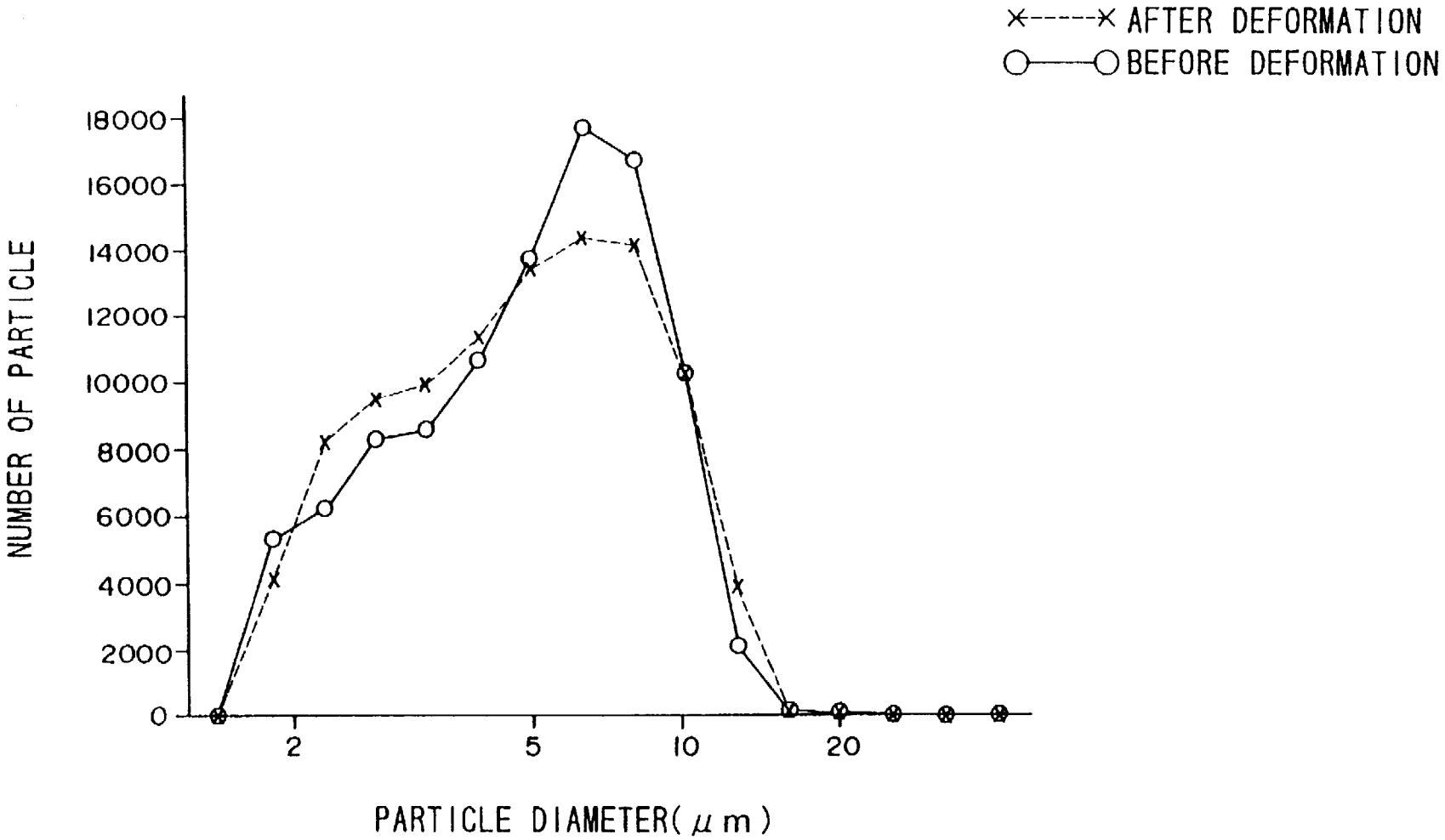
FIG. 10 is a graph of the particle size distributions of spherical toner particles and of deformed electrophotographic toner particles in Comparative Example 4.

The particle size distribution of the electrophotographic toner thus obtained was measured in the same manner as in Example 4. FIG. 10 shows the results. As shown by a broken line in FIG. 10, the particle size distribution of the deformed toner is greatly shifted from that of the toner before deformation (shown by a solid line in FIG. 10). In particular, an increase of smaller-size particles in the distribution was observed. Thus, it was confirmed that the toner particles themselves were also crushed due to a forcible disintegrated of the aggregates.

Comparative Example 5

Toner particles were employed, before being deformed, which were produced in the Production of Spherical Toner of Example 4, as Comparative Example 5.

Each of the electrophotographic toners prepared in Examples 4, 5 and Comparative Examples 4 and 5 was mixed with a ferrite carrier to prepare a two-component developer having a toner concentration of 3% by weight. Each two-component developer was used in an electrostatic copying apparatus [Model DC-1205 manufactured by Mita Industrial Co., Ltd.], and the cleaning test mentioned earlier was conducted for evaluating the cleaning properties under the conditions of ordinary temperature and humidity the temperature being 20° C. and the humidity being 65%) RH and under the conditions of high temperature and humidity (the temperature being 35° C. and the humidity being 85% RH)

The results are shown in Table 4.

TABLE 4

| Cleaning Properties | Example 4 | Example 5 | Comparative Example 4 | Comparative Example 5 |
|---|---|---|---|---|
| Ordinary Temp. & Humidity | 0.12 | 0.11 | 0.13 | 0.45 |
| High Temp. & Humidity | 0.12 | 0.11 | 0.13 | 0.55 |

The following observations were noted by inspection of the results in Table 4.

The spherical non-deformed electrophotographic toner (Comparative Example 5) was very poor in cleaning properties, and toner remained in a great amount on the surface of the photoreceptor drum.

On the other hand, the electrophotographic toner of Example 4 or 5 and Comparative Example 4 was excellent in cleaning properties in any environmental conditions, and hardly any toner remained on the surface of the photoreceptor drum.

Test of Image Forming Properties

Each of the electrophotographic toners of Examples 4, 5 and Comparative Example 4 were employed, and each, presented good results in the test of cleaning properties. With paper sheets for image transfer supplied to an electrostatic copying apparatus, the same document as in the test of cleaning properties was copied both under the aforesaid conditions. Each formed image was visually evaluated.

As to the formed images using the electrophotographic toners of Example 4 or 5, the image density corresponding to the strip of Munsell value N2.0 of the aforesaid document, was measured with the reflection densitometer.

The results are shown in Table 5.

TABLE 5

| | Example 4 | Example 5 | Comparative Example 4 |
|---|---|---|---|
| Formed Image | | | |
| Ordinary Temp. & Humidity | Good | Good | Good |
| High Temp. & Humidity | Good | Good | Fog |
| Image Density | About 1.2 | About 1.3 | — |

The following observations were noted by inspection of the results of Table 5.

The electrophotographic toner of Comparative Example 4 produced good images under the ordinary temperature and humidity environment, but formed a marked fog on the images under the high temperature and humidity environment.

On the other hand, both of the electrophotographic toners of Examples 4 and 5 produced good images in any environmental conditions.

Further, the image density corresponding to the strip of Munsell value N2.0 was about 1.2 for Example 4, and was about 1.3 for Example 5. These density values were practically sufficient.

Example 6

Production of Spherical Toner

Together with the following ingredients, 100 g of grafted carbon black (containing 40% by weight of styrene), produced by treating carbon black with a styrene monomer, was stirred at 100 r.p.m. for 10 minutes with the high-speed stirrer mentioned earlier, thus preparing a monomer-phase mixture.

| Ingredients | (g) |
|---|---|
| Monomer: | |
| Styrene | 400 |
| Butyl acrylate | 120 |
| Crosslinking Agent: | |
| Divinylbenzene | 1 |
| Polymerization Initiator: | |
| Benzoyl peroxide | 12 |
| Polymerization Adjusting Agent: | |
| t-Dodecyl mercaptan | 1 |
| Charge Controlling Agent: | |
| Bontron S-34 | 5 |

The monomer-phase mixture was mixed with 600 g of an ion exchange water serving as an aqueous dispersion medium, 65 g of hydroxy apatite as inorganic matter, and 100 g of concentrated hydrochloric acid (11N). The resulting mixture was stirred at 10000 r.p.m. with the high-speed stirrer mentioned earlier. The monomer-phase mixture was suspended in the form of drops, while the hydroxy apatite was dissolved in the aqueous dispersion medium. At the time three minutes elapsed from the stirring, 400 g of an aqueous solution of 4N sodium hydroxide was added to the reaction system under stirring. Accordingly, the hydroxy apatite was deposited on the surfaces of the drops. The reaction system was further stirred for another 30 minutes, thus preparing a suspension in which the average particle size of the drops was 10 μm.

The suspension was subjected to a polymerization reaction under conditions similar to those in Example 4. The reaction solution was split off using a Buchner funnel and a suction bottle, and then dried to give toner particles.

The average particle size of the toner particles thus obtained was 10 μm as measured with a coulter counter.

The tone particles were observed with an electron microscope, and it was confirmed that the toner particles were almost spherical and that the hydroxy apatite was uniformly deposited on the surfaces of the toner particles.

Deformation of Toner Particles

The spherical toner particles thus obtained were pressed and aggregated under a pressure of 200 kg/cm$^2$ with a hydraulic press. The aggregate was put in 0.5N dilute hydrochloric acid and stirred with a domestic mixer to dissolve and remove the hydroxy apatite, thus decomposing the aggregate into pieces. The pieces thus decomposed were filtered off, washed with ion exchange water and then dried, thus giving a deformed electrophotographic toner.

The electrophotographic toner thus obtained was observed, and it was confirmed that the toner was deformed as in Example 4.

Figure 11:
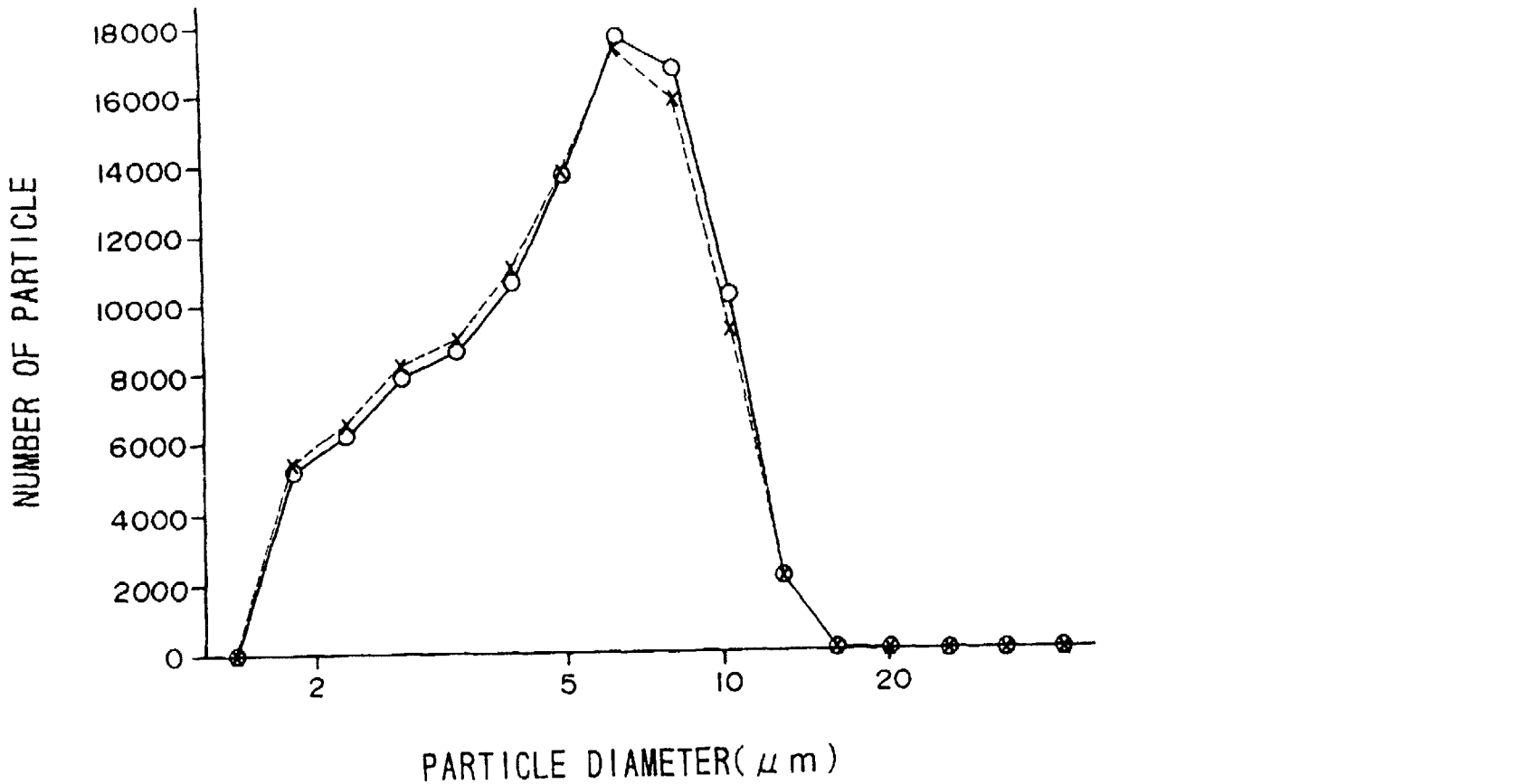
FIG. 11 is a graph of the particle size distributions of spherical toner particles and of deformed electrophotographic toner particles in Example 6.

The particle size distribution of the electrophotographic toner thus obtained was measured in a manner similar to that in Example 4. FIG. 11 shows the results. As shown by a broken line in FIG. 11, the particle size of the deformed toner is substantially the same as that of the toner before deformation (shown by a solid line in FIG. 11). Thus, it was confirmed that the particle size distribution did not change due to the deformation treatment.

Comparative Example 6

The monomer-phase mixture prepared in Example 6 was mixed with 1000 g of an ion exchange water as an aqueous dispersion medium and 30 g of polyvinyl alcohol as a dispersion stabilizer. The resulting mixture was stirred at 10000 r.p.m. for 30 minutes with the high-speed stirrer mentioned earlier to prepare a suspension in which the average particle size of the drops was 10 μm.

The suspension was subjected to a polymerization reaction under conditions similar to those in Example 4. The reaction solution was split off using a Buchner funnel and a suction bottle, and then dried to give toner particles.

The average particle size of the toner particles thus obtained was 10 μm as measured with a coulter counter.

Then, 100 g of the toner particles thus obtained was mixed with 3 g of hydroxy apatite (having a particle size of about 1 μm). The resulting mixture was aggregated as pressed under a pressure of 200 kg/cm$^2$ with a hydraulic press. The aggregate was coarsely crushed and then disintegrated with the supersonic-speed jet mill mentioned earlier until the particle size became about 10 μm. A deformed electrophotographic toner was thus prepared.

Figure 12:
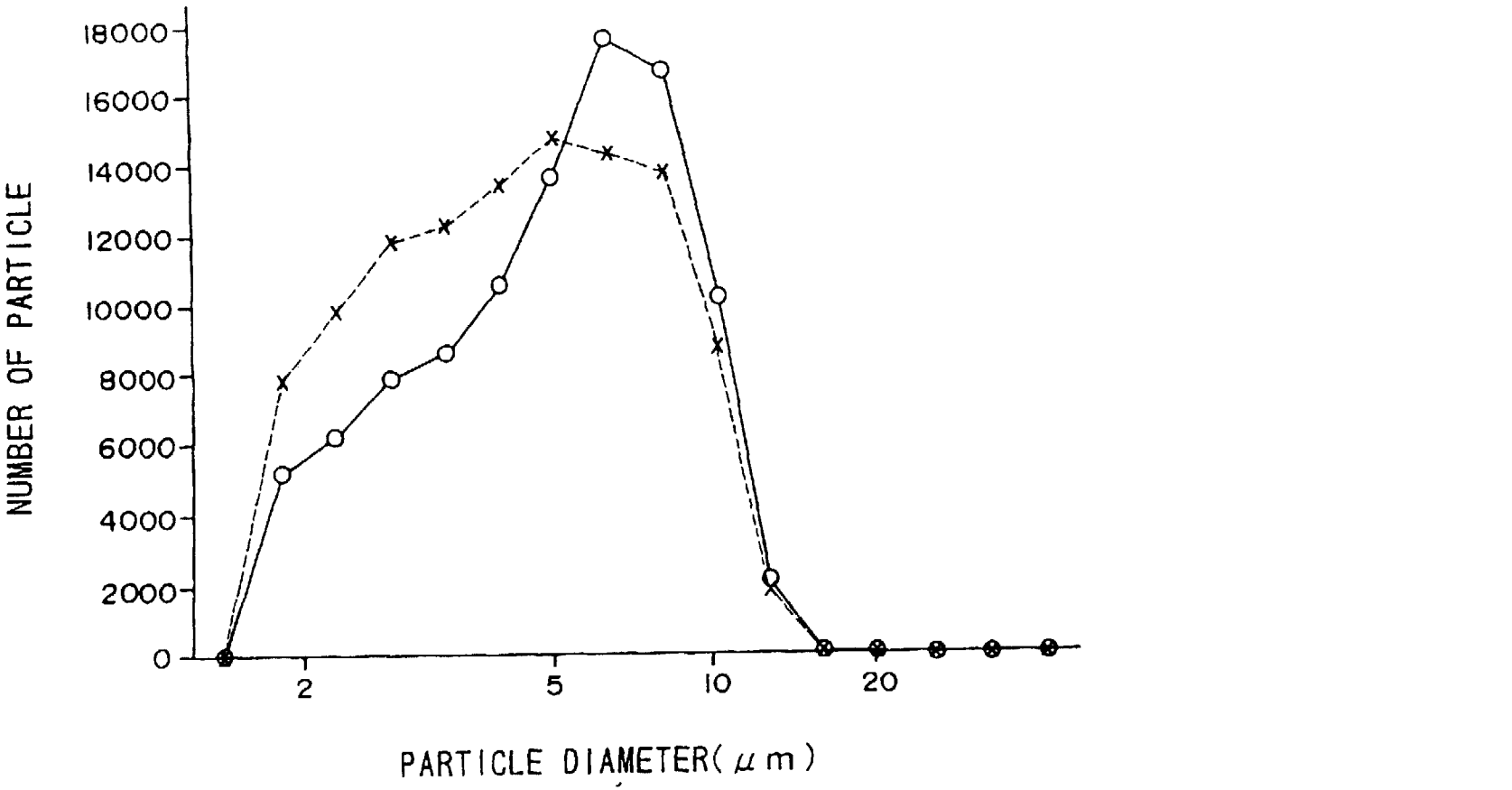
FIG. 12 is a graph of the particle size distributions of spherical toner particles and of deformed electrophotographic toner particles in Comparative Example 6.

The particle size distribution of the deformed electrophotographic toner thus obtained was measured in a manner similar to that in Example 4. FIG. 12 shows the results. As shown by a broken line in FIG. 12, the particle size distribution of the deformed toner is greatly shifted from that of the toner particles before deformation (shown by a solid line in FIG. 12). In particular, an increase of smaller-size particles was observed in the distribution. This showed that the toner particles themselves were also crushed due to a forcible disintegration of the aggregates.

Each of the electrophotographic toners prepared in Example 6 and Comparative Example 6 was mixed with a ferrite carrier to prepare a two-component developer having a toner concentration of 3% by weight. With the use of each two-component developer, the cleaning properties and image forming properties were evaluated in the aforesaid manners.

Table 6 shows the results of cleaning properties, and Table 7 shows the results of image forming characteristics.

TABLE 6

| Cleaning Properties | Example 6 | Comparative Example 6 |
|---|---|---|
| Ordinary Temp. & Humidity | 0.12 | 0.13 |
| High Temp. & Humidity | 0.12 | 0.13 |

As can be seen from the results in Table 6, both of the electrophotographic toners of Example 6 and Comparative Example 6, were excellent in cleaning properties in any environmental conditions, and hardly any toner remained on the surface of the photoreceptor drum.

TABLE 7

| | Example 6 | Comparative Example 6 |
|---|---|---|
| Formed Image | | |
| Ordinary Temp. & Humidity | Good | Good |
| High Temp. & Humidity | Good | Fog |
| Image Density | About 1.2 | — |

The following observations were noted by inspection of the results of Table 7.

The electrophotographic toner of Comparative Example 6 produced good images under the ordinary temperature and humidity environment, but a marked fog was observed on the images under the high temperature and humidity environment.

On the other hand, the electrophotographic toner of Example 6 produced good images in any environmental conditions. Further, the image density corresponding to the strip of Munsell value N2.0 was about 1.2 for Example 6, thus being practically sufficient.

Example 7

Production of Spherical Toner

Together with the following ingredients, 100 g of grafted carbon black (containing 40% by weight of styrene) produced by treating carbon black with a styrene monomer, was stirred at 100 r.p.m. for 10 minutes with the high-speed stirrer, thus preparing a monomer-phase mixture.

| Ingredients | (g) |
|---|---|
| Monomer: | |
| Styrene | 400 |
| Butyl acrylate | 120 |
| Crosslinking Agent: | |
| Divinylbenzene | 0.5 |
| Polymerization Initiator: | |
| Benzoyl peroxide | 12 |
| Polymerization Adjusting Agent: | |
| t-Dodecyl mercaptan | 1 |
| Charge Controlling Agent: | |
| Bontron S-34 | 5 |

The monomer-phase mixture was mixed with 2000 g of an ion exchange water serving as an aqueous dispersion medium and 65 g of polyvinyl alcohol as a dispersion stabilizer. The resulting mixture was stirred at 10000 r.p.m. for 30 minutes with the high-speed stirrer mentioned earlier. A suspension was prepared in which the average particle size of the drops was 10 μm.

The suspension was subjected to a polymerization reaction under conditions similar to those in Example 4, thus forming toner particles. To the reaction system, 62 g of hydroxy apatite as inorganic matter and 100 g of concentrated hydrochloric acid (11N) were added under stirring such that the hydroxy apatite was dissolved in the aqueous dispersion medium.

At the time at which the hydroxy apatite was completely dissolved, 400 g of an aqueous solution of 4N sodium hydroxide was added to the reaction system under stirring. The reaction system was further stirred for another five minutes to deposit the hydroxy apatite on the surfaces of the toner particles.

The reaction solution was split off using a Buchner funnel and a suction bottle, and then dried to give toner particles.

The average particle size of the toner particles thus obtained was 10 μm as measured with a coulter counter.

The toner particles were observed with an electron microscope, and it was confirmed that the toner particles were almost spherical and that the hydroxy apatite was uniformly deposited on the surfaces of the toner particles.

Deformation of Toner Particles

While heating the spherical toner particles thus obtained up to a temperature of 80° C., they were aggregated by being pressed under a pressure of 1 kg/cm$^2$. The aggregate was put in 0.5N dilute hydrochloric acid and stirred with a domestic mixer to dissolve and remove the hydroxy apatite, thus decomposing the aggregate into pieces. The pieces thus decomposed were filtered off, washed with ion exchange water and then dried, thus giving deformed toner particles.

The toner particles thus obtained were observed, and it was confirmed that the toner particles were deformed as in Example 4.

Figure 13:
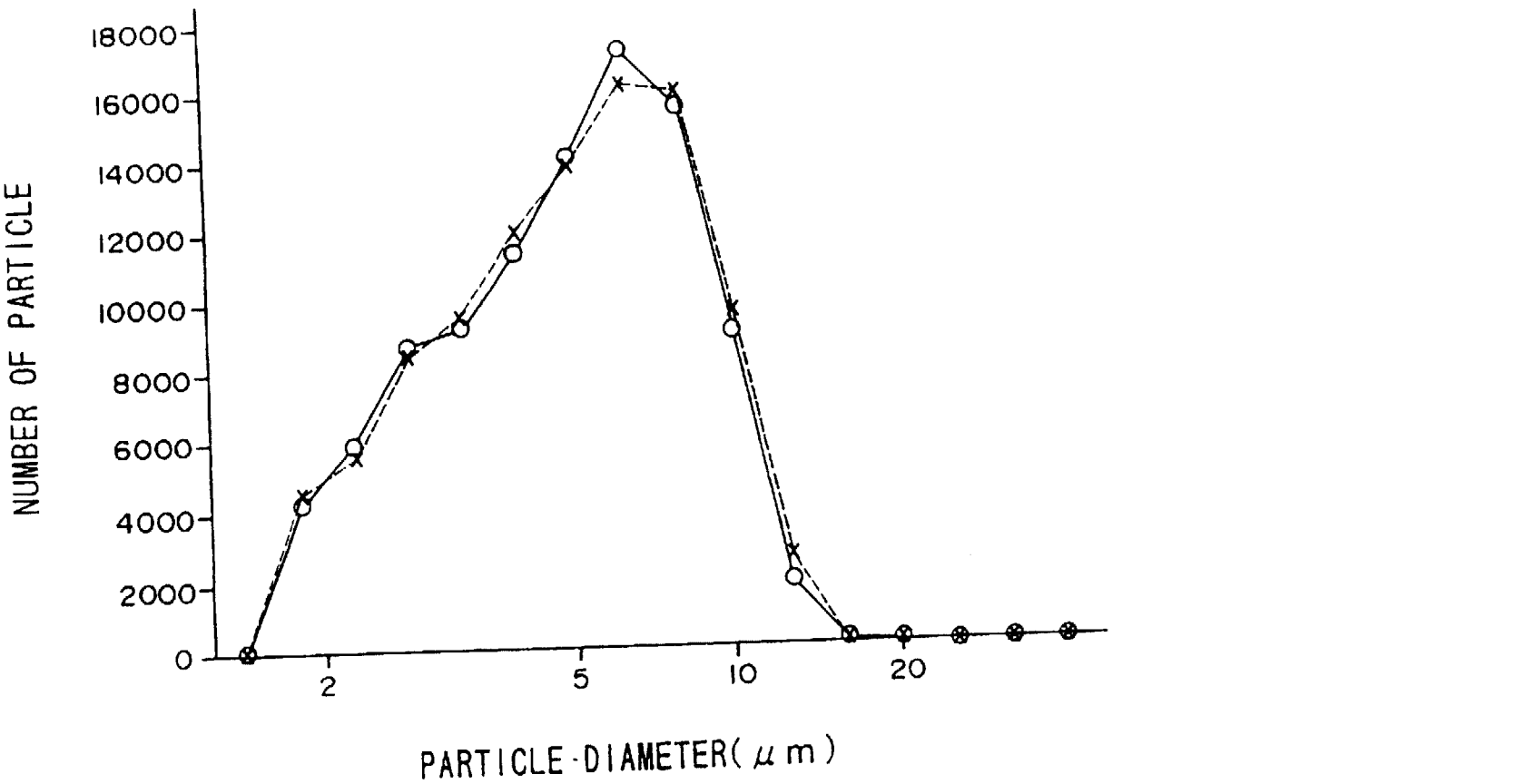
FIG. 13 is a graph of the particle size distributions of spherical toner particles and of deformed electrophotographic toner particles in Example 7.

The particle size distribution of the electrophotographic toner thus obtained was measured in a manner similar to that in Example 4. FIG. 13 shows the results. As shown by a broken line in FIG. 13, the particle size of the deformed toner was substantially the same as that of the toner before deformation (shown by a solid line in FIG. 13). Thus, it was confirmed that the particle size distribution did not change due to the deformation treatment.

Comparative Example 7

To the suspension as obtained after the polymerization reaction in Example 7, there was added 62 g of hydroxy apatite powder (having a particle size of about 1 μm) serving as inorganic fine particles, and the resulting mixture was sufficiently stirred. Thereafter, the reaction solution was split off using a Buchner funnel and a suction bottle, and then dried to give toner particles.

The average particle size of the toner particles thus obtained was 10 μm as measured with a coulter counter.

The toner particles were observed with an electron microscope, and it was confirmed that the toner particles were almost spherical and that the hydroxy apatite powder was adsorbed to the surfaces of the toner particles.

While heating the toner particles up to a temperature of 80° C., they were aggregated by being pressed under pressure of 1 kg/cm$^2$. Then, the aggregate was coarsely crushed and then disintegrated with the supersonic-speed jet mill mentioned earlier until the particle size became about 10 μm. Thus, a deformed electrophotographic toner was prepared.

Figure 14:
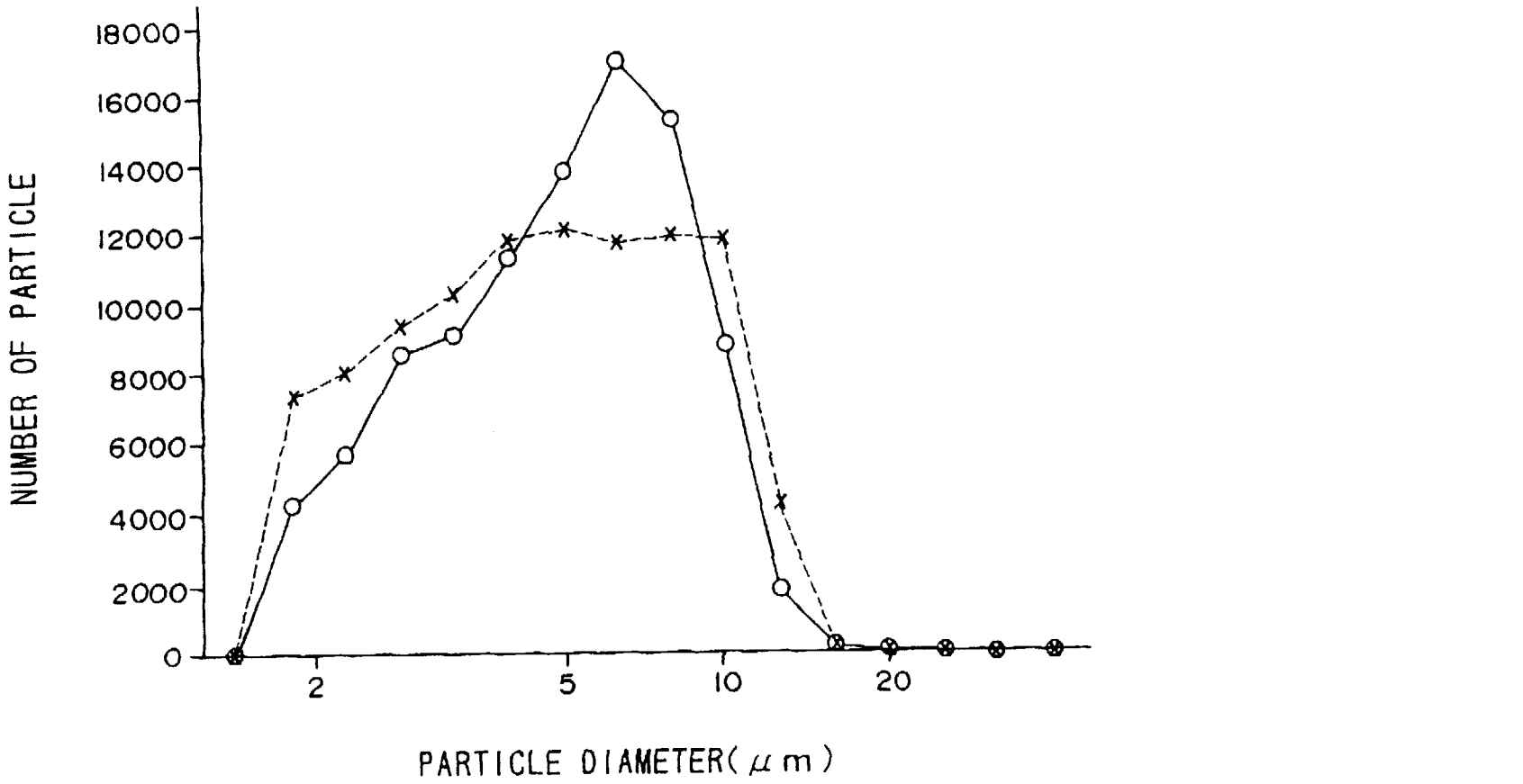
FIG. 14 is a graph of the particle size distributions of spherical toner particles and of deformed electrophotographic toner particles in Comparative Example 7

The particle size distribution of the electrophotographic toner thus obtained was measured in a manner similar to that in Example 4. FIG. 14 shows the results. As shown by a broken line in FIG. 14, the particle size of the deformed toner is greatly shifted from that of the toner before deformation (shown by a solid line in FIG. 14). In particular, an increase of smaller-size particles was observed in the distribution. Thus, it was confirmed that the toner particles themselves were also crushed due to a forcible disintegration of the aggregates. Further, a slight increase of larger-size particles was observed in the distribution. This showed that some toner particles were welded to one another.

Each of the electrophotographic toners prepared in Example 7 and Comparative Example 7 was mixed with a ferrite carrier to prepare a two-component developer having a toner concentration of 3% by weight. With the use of each two-component developer, the cleaning properties and image forming properties were evaluated in the aforesaid manners.

Table 8 shows the results of the cleaning properties, and Table 9 shows the results of the image forming properties.

TABLE 8

| Cleaning Properties | Example 7 | Comparative Example 7 |
|---|---|---|
| Ordinary Temp. & Humidity | 0.14 | 0.13 |
| High Temp. & Humidity | 0.14 | 0.13 |

As apparent from the results in Table 8, it was noted that both of the electrophotographic toners of Example 7 and Comparative Example 7 were excellent in cleaning properties under any environmental conditions, and hardly any toner remained on the surface of the photoreceptor drum.

TABLE 9

| | Example 7 | Comparative Example 7 |
|---|---|---|
| Formed Image | | |
| Ordinary Temp. & Humidity | Good | Good |
| High Temp. & Humidity | Good | Fog |
| Image Density | About 1.3 | — |

The following observations were noted by inspection of Table 9.

The electrophotographic toner of Comparative Example 7 produced good images in the ordinary temperature and humidity environment, but a marked fog was observed on the images in the high temperature and humidity environment.

On the other hand, the electrophotographic toner of Example 7 produced good images under any environmental conditions. Further, the image density corresponding to the strip of Munsell value N2.0 was about 1.3 for Example 7, thus being practically sufficient.

Example 8

The following ingredients were stirred at 100 r.p.m. for 10 minutes with the high-speed stirrer, thus preparing a monomer-phase mixture.

| Ingredients | (g) |
|---|---|
| Monomer: | |
| Styrene | 500 |
| 2-Ethylhexyl methacrylate | 120 |
| Crosslinking Agent: | |
| Divinylbenzene | 1 |
| Coloring Agent: | |
| Carbon black | 30 |
| Coupling Agent: | |
| Methyl trimethoxy silane | 3 |
| Polymerization Initiator: | |
| Benzoyl peroxide | 12 |
| Polymerization Adjusting Agent: | |
| t-Dodecyl mercaptan | 1 |
| Charge Controlling Agent: | |
| Azo oil black | 5 |

The monomer-phase mixture was mixed with 2000 g of an ion exchange water serving as an aqueous dispersion medium, 40 g of silica sol (particle size of about 0.2 μm) as inorganic fine particles and 0.02 g of sodium dodecylbenzenesulfonate as a dispersion stabilizer. The resulting mixture was stirred at 10000 r.p.m. for 30 minutes with the high-speed stirrer mentioned earlier, thereby to prepare a suspension in which the average particle size of the drops was 10 μm.

The suspension was subjected to a polymerization reaction under conditions similar to those used in Example 4. The reaction solution was concentrated using a Buchner funnel and a suction bottle, thereby to give a toner cake having a water content of 65% by weight.

The glass transition temperature (Tg) for a resin part of the toner cake thus formed, was about 72° C. as measured by a differential scanning calorimeter.

The average particle size of the toner particles contained in the toner cake was 10 μm as measured with a coulter counter.

The toner particles thus obtained were observed with an electron microscope, and it was confirmed that the toner particles were almost spherical and that a large number of silica fine particles were attached to the surface of the toner particles.

Deformation of Toner Particles

The toner cake thus obtained was aggregated by being thermally treated at 100° C. for one hour in an oven having a ventilating mechanism. The resulting aggregate was put in an aqueous solution of 4N sodium hydroxide and stirred with a domestic mixer to dissolve and remove the silica fine particles, thus decomposing the aggregate into pieces. The pieces thus decomposed were filtered off, washed with ion exchange water and then dried, thus giving a deformed electrophotographic toner.

The electrophotographic toner thus obtained was observed, and it was confirmed that the toner was deformed as in Example 4.

Figure 15:
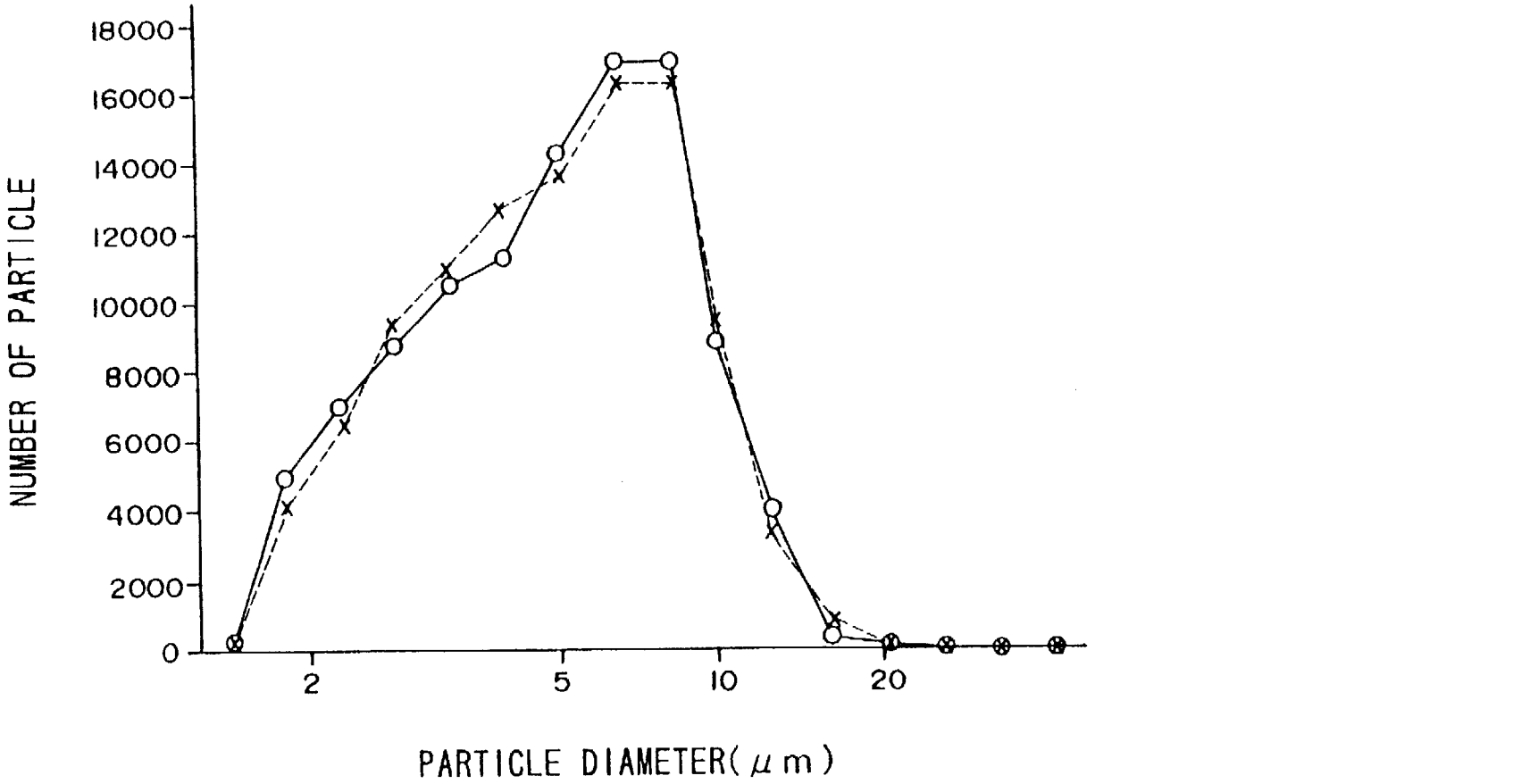
FIG. 15 is a graph of the particle size distributions of spherical toner particles and of deformed electrophotographic toner particles in Example 8.

The particle size distribution of the electrophotographic toner thus obtained was measured in a manner similar to that in Example 4. FIG. 15 shows the results. As shown by a broken line in FIG. 15, the particle size of the deformed toner is substantially the same as that of the toner before deformation (shown by a solid line in FIG. 15). Thus, it was confirmed that the particle size distribution did not change due to the deformation treatment.

Comparative Example 8

Production of Spherical Toner

The monomer-phase mixture prepared in Example 6 was mixed with 1000 g of an ion exchange water as an aqueous dispersion medium and 30 g of polyvinyl alcohol as a dispersion stabilizer. The resulting mixture was stirred at 10000 r.p.m. for 30 minutes with the high-speed stirrer mentioned earlier to prepare a suspension in which the average particle size of the drops was 10 μm.

The suspension was subjected to a polymerization reaction under conditions similar to those in Example 4. The reaction solution was split off using a Buchner funnel and a suction bottle, and then dried to give toner particles.

The average particle size of the toner particles thus obtained was 10 μm as measured with a coulter counter.

The glass transition temperature (Tg) for the toner particles thus obtained was about 70° C. as measured by a differential scanning calorimeter.

Deformation of the Toner Particles The toner particles thus obtained were moistened with water such that the toner particles had a moisture content of 65% by weight. The toner particles were aggregated by being thermally treated at 80° C. for one hour in an oven having a ventilating mechanism. The resulting aggregate was coarsely crushed and then disintegrated with the supersonic-speed jet mill mentioned earlier until the particle size became about 10 μm. Thus, a deformed electrophotographic toner was prepared.

Figure 16:
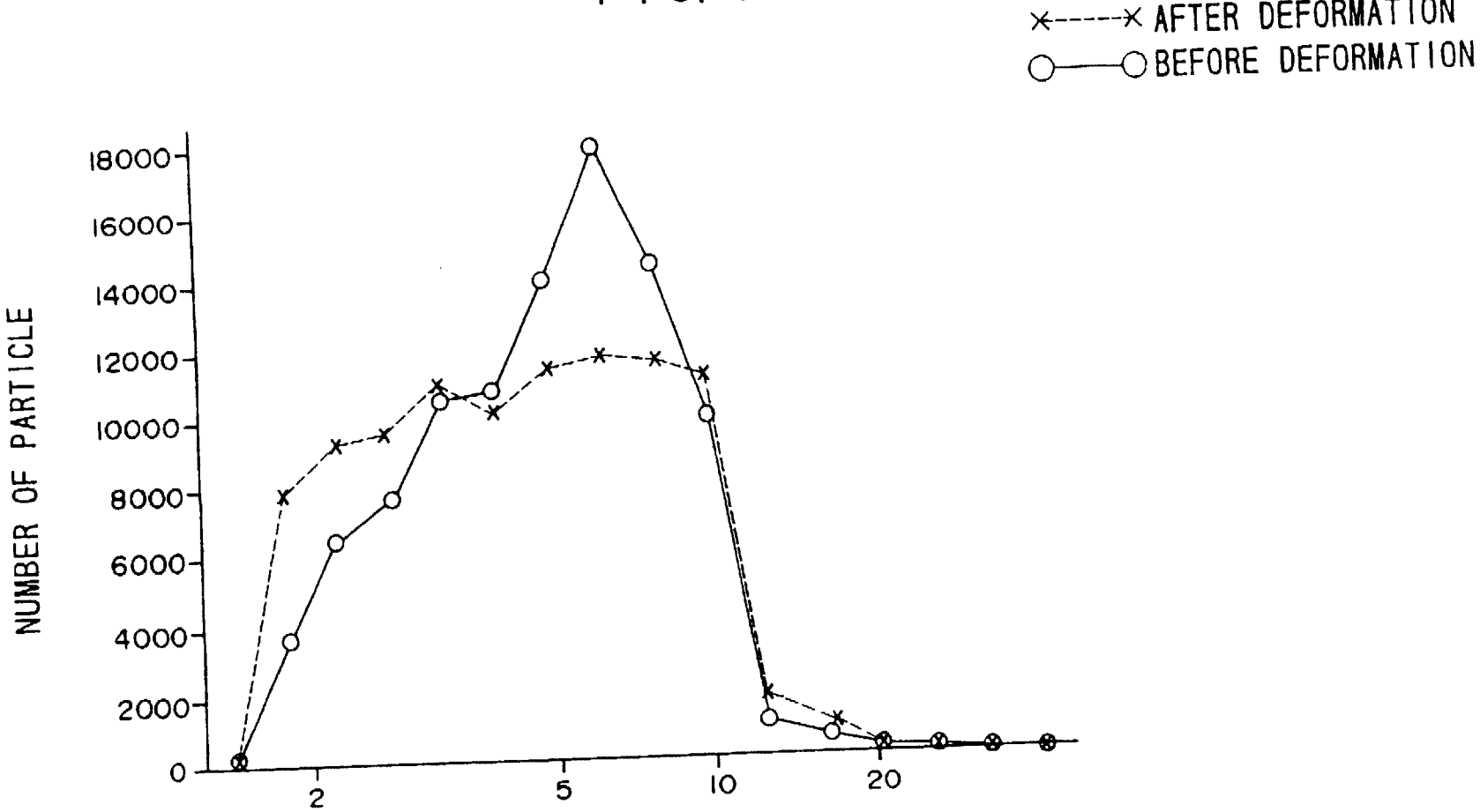
FIG. 16 is a graph of the particle size distributions of spherical toner particles and of deformed electrophotographic toner particles in Comparative Example 8.

The particle size distribution of the electrophotographic toner thus obtained was measured in a manner similar to that in Example 4. FIG. 16 shows the results. As shown by a broken line in FIG. 16, the particle size of the deformed toner is shifted from that of the toner particles before deformation (shown by a solid line in FIG. 16).

In particular, there was observed an increase in smaller-size particles in the distribution. This showed that the toner particles themselves were also crushed due to a forcible disintegration of the aggregates.

There also was observed a slight increase in larger-size particles. This showed that some toner particles were welded to one another.

Comparative Example 9

1000 g of the toner particles prepared in Comparative Example 8 was put in a cylinder having an inner diameter of 30 mm. Using a hydraulic press, a pressure of 0.5 kg/cm$^2$ was applied, at room temperature, to the toner particles for 30 seconds, causing the toner particles to be aggregated. The resulting aggregate was disintegrated as done in Comparative Example 8.

Through the observation of the disintegrated pieces with an electron microscope, the following observations were confirmed.

Aggregates each comprising a plurality of toner particles were mingled with spherical toner particles which had hardly been deformed. This showed that the above disintegrated pieces were not applicable to an electrophotographic toner.

Each of the electrophotographic toners prepared in Example 8 and Comparative Example 8 was mixed with a ferrite carrier to prepare a two-component developer having a toner concentration of 3% by weight. With the use of each two-component developer, the cleaning properties and image forming properties were evaluated in manners similar to those mentioned earlier. Table 10 shows the results of the cleaning properties, and FIG. 11 shows the results of the image forming properties.

TABLE 10

| Cleaning Properties | Example 8 | Comparative Example 8 |
|---|---|---|
| Ordinary Temp. & Humidity | 0.11 | 0.10 |
| High Temp. & Humidity | 0.11 | 0.10 |

As apparent from the results in Table 10, it was noted that both of the electrophotographic toners of Example 8 and Comparative Example 8 were excellent in cleaning properties under any environmental conditions, and hardly any toner remained on the surface of the photoreceptor drum.

TABLE 11

| | Example 8 | Comparative Example 8 |
|---|---|---|
| Formed Image | | |
| Ordinary Temp. & Humidity | Good | Good |
| High Temp. & Humidity | Good | Fog |
| Image Density | About 1.3 | About 1.2 |

The following observations were noted by inspection of Table 11.

The electrophotographic toners of Comparative Example 8 produced good images in the ordinary temperature and humidity environment, but a marked fog was observed on the images in the high temperature and humidity environment.

On the other hand, the electrophotographic toner of Example 8 produced good images under any environmental conditions.

As to the formed images, the image density corresponding to the strip of Munsell value N2.0 for Example 8 was about 1.3, thus being practically sufficient.

Examples 9 to 11

Electrophotographic toners were prepared in a manner similar to that in Example 8, except that the moisture content of the toner cake was set to 43% by weight for Example 9, 7% by weight for Example 10 and 0% by weight for Example 11.

Each of the electrophotographic toners prepared in Examples 9, 10 and 11 was mixed with a ferrite carrier to prepare a two-component developer having a toner concentration of 3% by weight. With the use of each two-component developer, the cleaning properties were evaluated in the normal temperature and humidity environment wherein the temperature was 20° C. and humidity was 65% RH, in a manner similar to that mentioned earlier.

Electron micrographs for the electrophotographic toners of Examples 9 to 11 and Example 8 were taken. About 100 toner particles of each Example were measured at longer and shorter diameters thereof, and the mean was determined as a degree of deformation.

Table 12 shows the results of deformation degree test, together with the results of the cleaning properties test, in the ordinary temperature and humidity environment.

TABLE 12

| | Example 8 | Example 9 | Example 10 | Example 11 |
|---|---|---|---|---|
| Moisture Content (wt %) | 65 | 43 | 7 | 0 |
| Cleaning Properties | 0.11 | 0.12 | 0.24 | 0.32 |
| Deformation Degree | 1.32 | 1.29 | 1.15 | 1.08 |

The following observations were noted by inspection of Table 12.

As the moisture content of the toner cake was increased, the degree of deformation of the produced electrophotographic toner became greater, so that the cleaning properties improved.

In particular, both electrophotographic toners of Examples 8 and 9, wherein moisture content of the toner cake was not less than 43% by weight, were remarkably excellent in cleaning properties, so that the entire toner particles were cleaned.

Example 12

Production of Spherical Toner 2.5 g of a methacrylatemethyl acrylate copolymer as a dispersion stabilizer was dissolved in 200 g of ethanol and 40 g of refined water as a dispersion medium for a dispersion polymerization. The following ingredients were then dissolved in the resulting solution.

| Ingredients | (g) |
|---|---|
| Monomer: | |
| Styrene | 60 |
| Polymerization Initiator: | |
| Azobisisovaleronitrile | 2.5 |
| Coloring Agent: | |
| Oil-soluble red dye | 1.8 |

The resulting solution was transferred to a 1 liter separable flask having a stirrer, a nitrogen inlet tube and a condenser. While stirred at 40 r.p.m. under nitrogen atmosphere, the solution was heated to 50° C. and subjected to a polymerization reaction for 200 minutes. While the reaction system was continuously stirred, water was dropped into the flask at a speed of 0.1 ml/minute for 1000 minutes with the use of a microfeeder (manufactured by Furue Science Co., Ltd.).

The dispersion was observed with an optical microscope upon completion of water dropping, and the formation of monodisperse red spherical toner particles which had a particle size of about 7 μm was confirmed.

To the aforesaid dispersion, there was added 20 g of barium sulfate powder (having a particle size of about 1 μm) as inorganic fine particles. The dispersion was split off using a Buchner funnel and a suction bottle, and then dried to give a toner cake having a moisture content of 45% by weight.

The glass transition temperature (Tg) for a resin part of the toner cake thus formed, was about 69° C. as measured by a differential scanning calorimeter.

Deformation of Toner Particles

The toner cake thus obtained was aggregated by being thermally treated at 75° C. for three hours in an oven having a ventilating mechanism. The resulting aggregate was put in 0.5N dilute hydrochloric acid and stirred with a domestic mixer to dissolve and remove the barium sulfate, thus decomposing the aggregate into pieces. The pieces thus decomposed were filtered off, washed with an ion exchange water and then dried, thus giving a red deformed electrophotographic toner.

Figure 17:
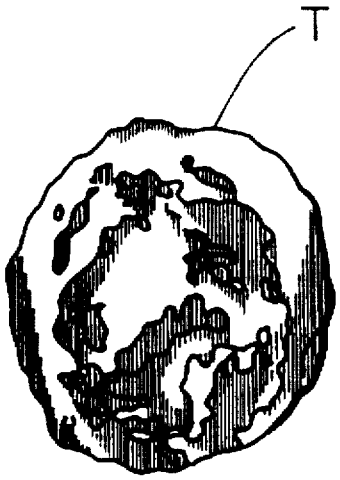
FIG. 17 is a front view illustrating the external appearance of an electrophotographic toner particle prepared in Example 12.

The electrophotographic toner thus obtained was observed with an electron microscope, and it was confirmed that the toner T was deformed as shown in FIG. 17.

Figure 18:
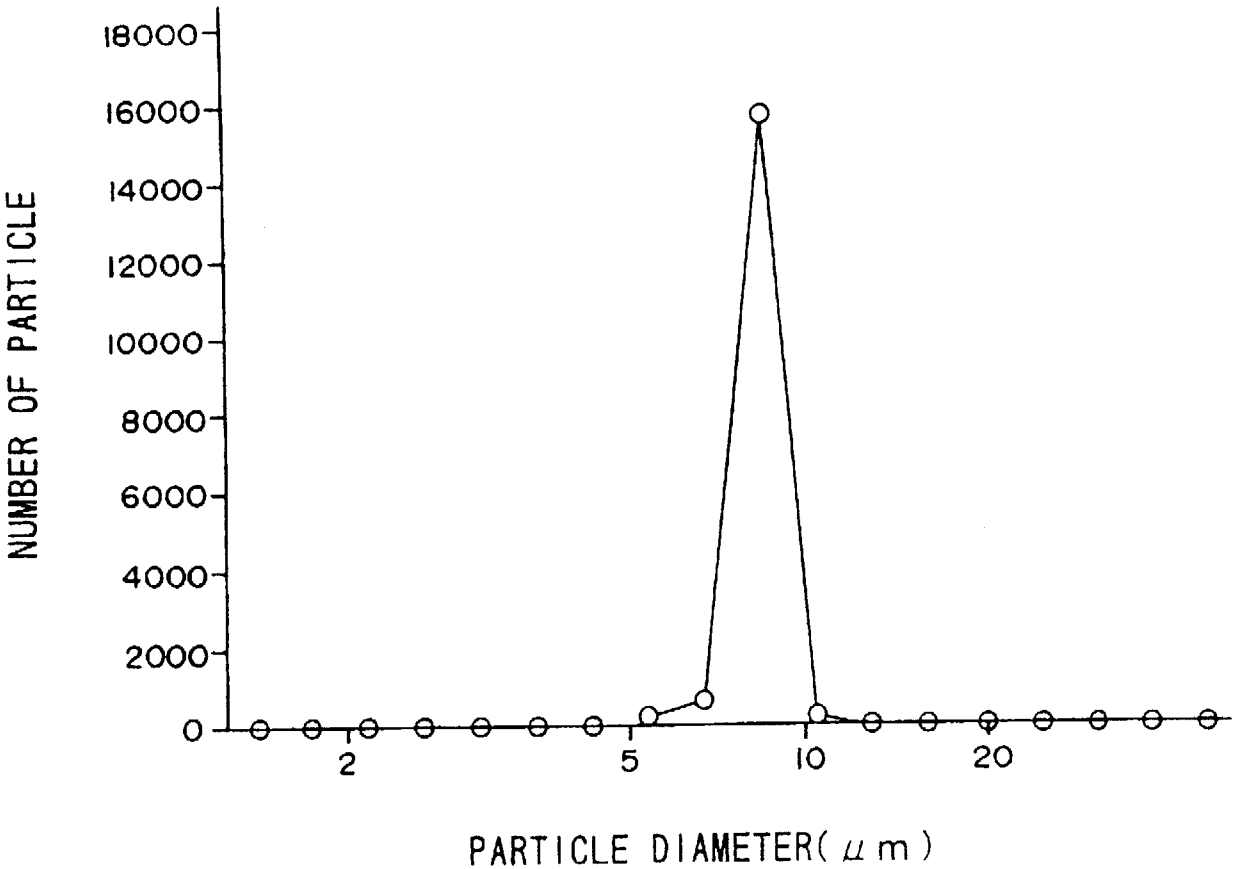
FIG. 18 is a graph of the particle size distribution of the electrophotographic toner particles in Example 12.

FIG. 18 shows the particle size distribution of the electrophotographic toner as measured with a coulter counter. As shown in FIG. 18, the toner particles presented a monodisperse distribution of about 7 μm. This showed that the particle size distribution did not change due to the deformation treatment.

Example 13

3 g of polymethacrylate as a dispersion stabilizer was dissolved in 240 g of ibutanol and 40 g of a refined water as a dispersion medium for a dispersion polymerization. The following ingredients were then dissolved in the resulting solution.

| Ingredients | (g) |
|---|---|
| Monomer: | |
| Styrene | 45 |
| Methyl methacrylate | 15 |
| Nitrostyrene | 0.1 |

-continued

| Ingredients | (g) |
|---|---|
| Polymerization Initiator: | |
| Azobisisobutyronitrile | 2.5 |

The resulting solution was transferred to a 1 liter-separable flask having a stirrer, a nitrogen inlet tube and a condenser. While stirring at 40 r.p.m. under nitrogen atmosphere, the solution was heated to 65° C. and subjected to a polymerization reaction for 8 hours.

Thereafter, the reaction solution was filtered off to give monodisperse non-colored spherical resin particles having a size of about 5 μm.

Together with 6 g of a quinone-type blue disperse dye and 40 g of silica sol (having a particle size of about 0.2 μm) as inorganic fine particles, 50 g of the resin particles thus obtained was dispersed in 1 liter-water and then subjected to a dyeing treatment at 140° C. for one hour using an autoclave.

Through the observation of the dyed resin particles with an optical microscope, it was confirmed that the resin particles were dyed in blue.

Then, the dye-treatment solution was split off using a Buchner funnel and a suction bottle, and then dried to give a toner cake.

Deformation of Toner Particles

The toner cake thus obtained was aggregated by being thermally treated and pressed at 70° C. under a pressure condition of 100 kg/cm$^2$ using a hydraulic press. The resulting aggregate was put in an aqueous solution of 4N sodium hydroxide and stirred with a domestic mixer to dissolve and remove the silica sol, thus decomposing the aggregate into pieces. The pieces thus decomposed were filtered off, washed with ion exchange water and then dried, thus giving a deformed blue electrophotographic toner.

Through the observation of the electrophotographic toner thus obtained with an electron microscope, it was confirmed that the toner was deformed as done in Example 12.

In a manner similar to that in Example 12, the particle size distribution of the electrophotographic toner thus obtained was measured. From the measurement result, it was confirmed that the particle size distribution showed a trend of a monodisperse of about 5 μ, and that no change due to the deformation treatment was observed.

Comparative Example 10

The spherical toner particles before deformation, as obtained in the Production of Spherical Toner of Example 12, were employed as Comparative Example 10.

Comparative Example 11

An electrophotographic toner was prepared by conducting a deformation treatment in a manner similar to that in Example 12, except that the toner-cake thermally treating temperature in the oven was sent to 65° C., which is lower than the glass transition temperature for the resin part. Through the observation of the electrophotographic toner obtained with an electron microscope, it was confirmed that the toner particles remained an almost spherical shape, and had hardly been deformed.

Each of the electrophotographic toners prepared in Example 12, 13, Comparative Example 10 and 11 was mixed with a ferrite carrier to prepare a two-component developer having a toner concentration of 3% by weight (2.3% by weight for Example 13). With the use of each two-component developer, the cleaning properties were evaluated in the ordinary temperature and the humidity environment wherein the temperature is 20° C. and humidity is 65% RH, in a manner similar to that mentioned earlier. Further, for Examples 12 and 13, the image forming properties were evaluated.

Table 13 shows the results.

TABLE 13

| | Example 12 | Example 13 | Comparative Example 10 | Comparative Example 11 |
|---|---|---|---|---|
| Cleaning Properties | 0.12 | 0.12 | 0.32 | 0.35 |
| Image Density | 1.02 | 1.1 | — | — |

The following observations were noted by inspection of Table 13.

Both electrophotographic toners of Comparative Examples 10 and 11 were very poor in cleaning properties, and a great amount of toner remained on the surface of the photoreceptor drum.

On the other hand, the deformed electrophotographic toner of Example 12 or 13 was excellent in cleaning properties, and hardly any toner remained on the surface of the photoreceptor drum.

As to the formed images, the image density corresponding to the strip of Munsell value N2.0 was about 1.02 for Example 12, and was about 1.1 for Example 13, thus being practically sufficient.

Example 14

Production of Spherical Toner

The following ingredients were sufficiently mixed and dispersed using a supersonic dispersing machine to prepare a spray solution to be sprayed and dried.

| Ingredients | (g) |
|---|---|
| Fixing Resin: | |
| Styrene-butyl acrylate copolymer | 400 |
| Coloring Agent: | |
| Carbon black | 20 |
| Charge Controlling agent: | |
| Bontron S-34 | 5 |
| Solvent: | |
| Toluene | 8000 |

Using a spray dryer (Model CL-8 manufactured by Ohgawara Kakouki Co., Ltd.), the spray solution was sprayed and dried to give spherical toner particles having the average particle size of 10 μm.

Deformation of Toner Particles 100 g of the spherical toner particles thus obtained was mixed with 40 g of sodium chloride powder (having a particle size of about 1 μm) as inorganic fine particles. The resulting mixture was aggregated as by being pressed under a condition of 200 kg/cm$^2$.

The resulting aggregate was put in a great amount of water and stirred with a domestic mixer to dissolve and remove the sodium chloride, thus decomposing the aggregate into pieces. The pieces thus decomposed were filtered off, washed with ion exchange water and then dried, thus giving a deformed electrophotographic toner.

Through the observation of the electrophotographic toner thus obtained with an electron microscope, it was confirmed that the toner was deformed as done in Example 4.

Figure 19:
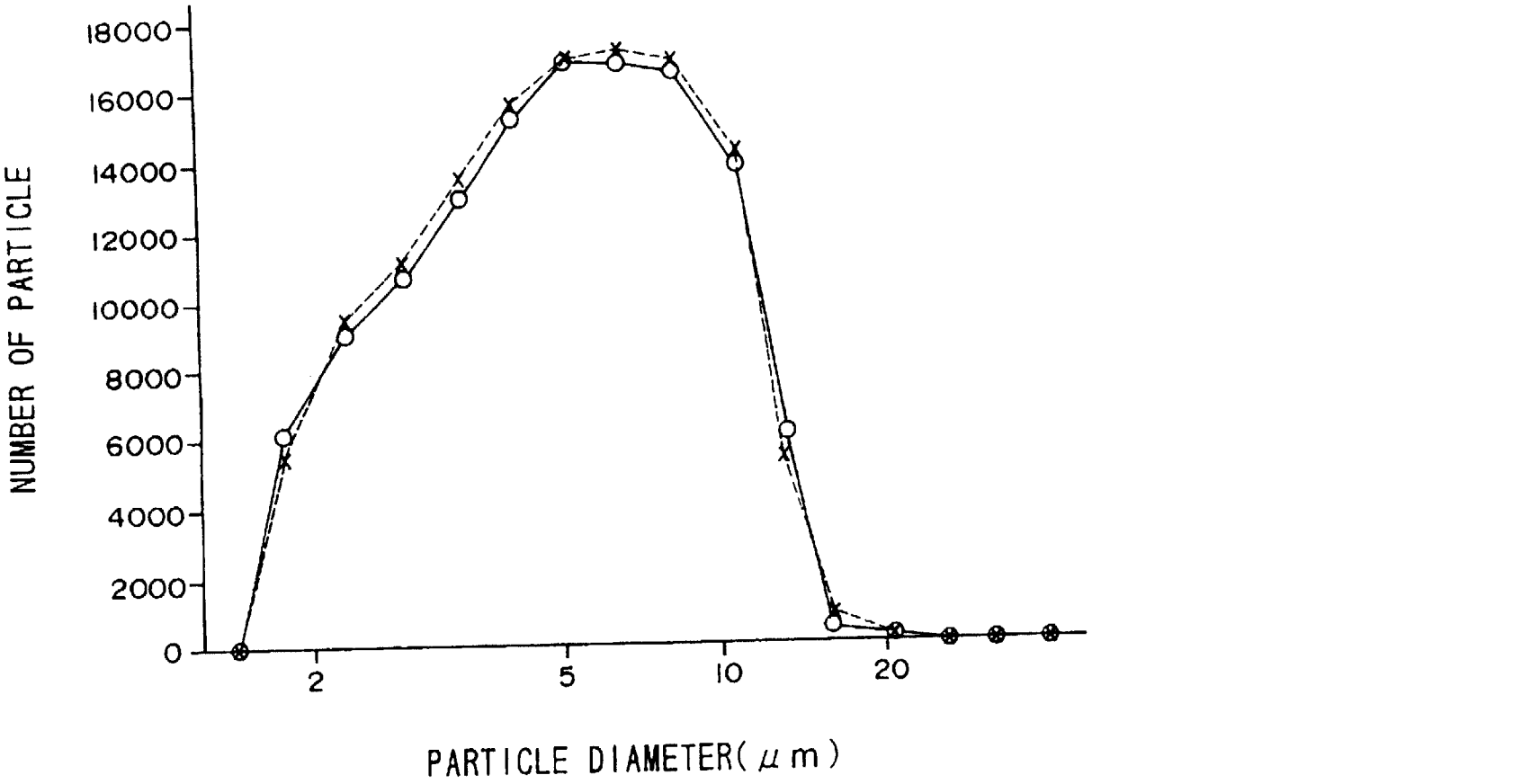
FIG. 19 is a graph of the particle size distribution of electrophotographic toner particles in Example 14.

FIG. 19 shows the result of the particle size distribution for the electrophotographic toner as measured by a coulter counter. As shown by a broken line in FIG. 19, the particle size of the deformed toner was substantially the same as that of the toner before deformation (shown by a solid line in FIG. 19). This showed that the particle size distribution did not change due to the deformation treatment.

What is claimed is:

1. A method of producing an electrophotographic toner comprising preparing a monomer-phase mixture wherein said mixture contains: (i) a polymerizable monomer serving as a raw material of a fixing resin of said toner and (ii) fine particles selected from the group consisting of fine particles of crosslinking resin having a primary particle size of 1% to 30% of a particle size of said toner, and water insoluble inorganic fine particles which have said primary particle size and which have been treated to increase their affinity with said monomer, wherein a mixing ratio of said fine particles to said monomer is in a range of 0.1% to 100% by weight, and wherein said fine particles are added to said monomer and said fine particles and monomer are subsequently added to a dispersion medium; and polymerizing said monomer-phase mixture while suspended, in the form of drops, in said dispersion medium in which said polymerizable monomer is insoluble, wherein said toner is provided on a surface thereof with numerous projections made of said fine particles.

2. The method of producing the electrophotographic toner according to claim 1, further including adding a coloring agent to the monomer-phase mixture before the polymerization thereby to color the toner.

3. The method of producing the electrophotographic toner according to claim 1, further including subjecting the inorganic fine particles to a grafting treatment in a polymerizable monomer identical with or different from said polymerizable monomer contained in the monomer-phase mixture to form a treatment solution, for increasing the affinity of said inorganic fine particles with said polymerizable monomer serving as said raw material of the fixing resin of the toner, and then preparing said monomer-phase mixture using said treatment solution.

4. The method of producing the electrophotographic toner according to claim 1, wherein said dispersion medium is selected from the group consisting of water, and a mixed solvent containing water and an organic solvent.

5. A method of producing an electrophotographic toner comprising:

deforming substantially spherical toner particles by aggregating said toner particles with inorganic matter intervening thereamong to form an aggregate; and chemically dissolving and removing said inorganic matter to decompose the resulting aggregate of said toner particles and said inorganic matter.

6. The method of producing the electrophotographic toner according to claim 5, further including polymerizing a monomer-phase mixture containing a polymerizable monomer serving as a raw material of a fixing resin of said toner, while suspended, in the form of drops, in a dispersion medium in which said polymerizable monomer is insoluble to thereby produce substantially spherical toner particles by suspension polymerization.

7. The method of producing the electrophotographic toner according to claim 6, further comprising:

dissolving, in said dispersion medium, said inorganic matter adapted to intervene among said toner particles in said aggregate, and chemically depositing said inorganic matter on the surface of said monomer-phase mixture dispersed, in the form of drops, in said dispersion medium.

8. The method of producing the electrophotographic toner according to claim 5, comprising:

preparing said substantially spherical toner particles by dispersion polymerization;

dissolving at least a polymerizable monomer, which is a raw material of a fixing resin of said toner in a medium to form a solution wherein said monomer is soluble but a polymer thereof is insoluble; and polymerizing the resulting solution under stirring.

9. A method of producing an electrophotographic toner according to claim 5, further including spraying a spray dry solution containing a fixing resin of said toner in the form of mist and drying said mist to form substantially spherical toner particles.

10. The method of producing the electrophotographic toner according to claim 5, further including chemically depositing, on surfaces of said toner particles, said inorganic matter intervening among said toner particles when aggregated, from a solution containing said inorganic matter.

11. The method of producing the electrophotographic toner according to claim 5, further including heating the toner particles and the inorganic matter in the presence of water, to a temperature on or higher than the glass transition temperature for a resin part of said toner particles to form said aggregate.

12. The process for producing an electrophotographic toner comprising:

dissolving at least a polymerizable monomer serving as a raw material of a fixing resin of the toner in a medium in which said polymerizable monomer is soluble but a polymer thereof is insoluble, thereby to form a solution;

polymerizing the resulting solution under stirring thereby to produce substantially spherical toner particles;

aggregating said toner particles with inorganic matter intervening thereamong to form an aggregate, wherein said toner particles are deformed in the aggregating step; and chemically dissolving and removing said inorganic matter to decompose the resulting aggregate, wherein an average particle size of said toner particle is in the range of 3 μm to 10 μm and the particle size distribution thereof is not greater than 1.30.

13. The process for producing the electrophotographic toner according to claim 12, further including adding a coloring agent to the medium together with the monomer, thereby to color the toner.

14. The process for producing the electrophotographic toner according to claim 12, further including coloring the toner particles after the polymerizing step.

* * * * *